US009085159B2

(12) United States Patent
Shinoto et al.

(10) Patent No.: US 9,085,159 B2
(45) Date of Patent: Jul. 21, 2015

(54) WIPER CASSETTE, WIPER UNIT AND LIQUID EJECTING APPARATUS

(71) Applicant: SEIKO EPSON CORPORATION, Tokyo (JP)

(72) Inventors: Akira Shinoto, Shimosuwa-machi (JP); Keiichiro Yoshino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/060,864

(22) Filed: Oct. 23, 2013

(65) Prior Publication Data

US 2014/0132667 A1 May 15, 2014

(30) Foreign Application Priority Data

Nov. 12, 2012 (JP) ..... 2012-248464

(51) Int. Cl.
*B41J 2/165* (2006.01)

(52) U.S. Cl.
CPC ..... *B41J 2/16544* (2013.01); *B41J 2/16535* (2013.01); *B41J 2002/1655* (2013.01)

(58) Field of Classification Search
CPC ..... B41J 2/16535; B41J 2/16552; B41J 2/16544; B41J 2/16547; B41J 2/165
USPC ..... 347/33
See application file for complete search history.

(56) References Cited

U.S. PATENT DOCUMENTS

| | | | | |
|---|---|---|---|---|
| 6,648,449 | B2 * | 11/2003 | Gonzalez | 347/33 |
| 2003/0189614 | A1 | 10/2003 | Steinfield et al. | |
| 2011/0261130 | A1 * | 10/2011 | Hirai et al. | 347/104 |

FOREIGN PATENT DOCUMENTS

| | | | |
|---|---|---|---|
| JP | 2001-260368 | | 9/2001 |
| JP | 2003-300329 | | 10/2003 |
| JP | 2005-212351 | | 8/2005 |
| JP | 2005212351 A | * | 8/2005 |
| JP | 2011-126129 | | 6/2011 |

* cited by examiner

*Primary Examiner* — Alessandro Amari
*Assistant Examiner* — Michael Konczal
(74) *Attorney, Agent, or Firm* — Workman Nydegger

(57) ABSTRACT

A wiper cassette includes a long wiping member which wipes a liquid adhered to a liquid ejecting head which ejects the liquid; a feed roller around which an end of the wiping member is wound in a longitudinal direction; and a winding roller around which other end of the wiping member is wound in the longitudinal direction, and the wiper cassette is mounted so as to be freely detachable and attachable into a wiper holder. Furthermore, the wiper cassette further includes a winding gear supported by the winding roller; and a power point acting portion on which a load acts in a removal direction when the wiper cassette is removed from the wiper holder, in which the power point acting portion is positioned closer to the removal direction side than the winding gear in a mounted state in which the wiper cassette is mounted into the wiper holder.

11 Claims, 18 Drawing Sheets

WIPER CASSETTE, WIPER UNIT AND LIQUID EJECTING APPARATUS

BACKGROUND

1. Technical Field

The present invention relates to a wiper cassette which wipes a liquid adhered to a liquid ejecting head which ejects a liquid, a wiper unit which contains the wiper cassette and a liquid ejecting apparatus which includes the wiper unit.

2. Related Art

In the related art, an ink jet printer, which forms an image or the like by ejecting a liquid from a liquid ejecting head onto a recording medium such as paper, is known as a type of liquid ejecting apparatus. Such a printer is normally provided with a head maintenance apparatus in order to maintain the characteristics of liquid ejecting from the liquid ejecting head.

An example of such a head maintenance apparatus is an ink wiping apparatus which performs maintenance by wiping liquid adhered to the liquid ejecting head (for example, refer to JP-A-2005-212351). Furthermore, in the ink wiping apparatus, a cassette, in which an ink absorber for wiping the ink from the ink ejecting head is mounted, is configured so as to be freely attachable and detachable in relation to the main body of the apparatus. Specifically, the cassette includes a feed roller around which a long unused ink absorber is wound in a roll-shape, and a winding roller which winds a used portion of the ink absorber which is unwound from the feed roller. Furthermore, when the entirety of the ink absorber wound around the feed roller is fed out and there is no longer an unused portion of the ink absorber, a new cassette, in which is an unused ink absorber is wound around a feed roller, is mounted into the main body of the apparatus.

However, in the ink wiping apparatus described above, there is a problem in that the cassette may not be easily exchanged by detachment and attachment thereof due to the cassette being mounted into the printer in an engaged manner.

SUMMARY

An advantage of some aspects of the invention is to provide a wiper cassette with favorable operability during the exchange thereof by detachment and attachment, a wiper unit which contains the wiper cassette and a liquid ejecting apparatus which includes the wiper unit.

Hereinafter, the following means of the invention and the operations and effects thereof will be described.

According to an aspect of the invention, there is provided a wiper cassette which includes a long wiping member which wipes a liquid adhered to a liquid ejecting head which ejects the liquid; a feed roller around which an end of the wiping member is wound in a longitudinal direction; and a winding roller around which other end of the wiping member is wound in the longitudinal direction, and the wiper cassette is mounted so as to be freely detachable and attachable into a wiper holder. Furthermore, the wiper cassette further includes a winding gear supported by the winding roller; and a power point acting portion on which a load acts in a removal direction when the wiper cassette is removed from the wiper holder, in which the power point acting portion is positioned closer to the removal direction side than the winding gear in a mounted state in which the wiper cassette is mounted into the wiper holder.

In this configuration, the power point acting portion upon which the user places their hand when the wiper cassette is removed from the wiper holder, is positioned closer to the removal direction (for example, the upward direction) side than the winding gear. Therefore, when the user places their hand on the power point acting portion in order to remove the wiper cassette, the concern that the winding gear becomes a hindrance may be reduced and the wiper cassette may be easily removed. Accordingly, favorable operability during the exchange of the wiper cassette by detachment and attachment may be achieved.

It is preferable that the wiper cassette further include a relay roller which is rotated by feeding the wiping member from the feed roller to the winding roller; and a relay gear which is supported by the relay roller so as to be capable of meshing with a detection gear, in which the detection gear is included in a rotation amount detection unit which is provided in the wiper holder in order to detect a feeding amount of the wiping member, in which the power point acting portion is positioned closer to the removal direction side than the relay gear in a mounted state.

For example, when the removal direction is the upward direction, the mounting direction is the downward direction and the relay gear is positioned further upward in the removal direction than the power point acting portion, the detection gear which meshes with the relay gear is positioned upward, which is the removal direction of the wiper holder. In such a case, when the wiper cassette is mounted into the wiper holder and the lower end portion, which is the end portion of the opposite side in the removal direction, of the wiper cassette makes strong contact with the detection gear, there is a concern that an impact will act on the rotation amount detection unit or the like. Therefore, it is necessary for the user to pay great attention mounting the wiper cassette into the wiper holder. Conversely, according to the configuration described above, the detection gear which meshes with the relay gear is positioned closer to the opposite side of the removal direction from the wiper holder than the power point acting portion. Therefore, in comparison with a case in which the detection gear is positioned closer to the removal direction side than the power point acting portion, it is less necessary to be careful at least when starting to mount the wiper cassette into the wiper holder. Accordingly, favorable operability during the mounting of the wiper cassette may be achieved.

It is preferable that in the wiper cassette, the feed roller be positioned between the winding roller and the power point acting portion in an axial intersection direction, which is the direction between the feed roller and the winding roller.

Due to repeatedly wiping the liquid adhered to the liquid ejecting head, a wiping member to which the liquid is adhered has an increased mass and is wound around the winding roller. As a result, the center of gravity of the wiper cassette moves closer to the winding roller side in the axial intersection direction in comparison to when the wiping member is not used. According to the configuration described above, when removing the wiper cassette, a load for removing the wiper cassette is applied to the power point acting portion which is positioned such that the power point acting portion and the winding roller interpose the feed roller therebetween. Accordingly, when the user places their hand on the power point acting portion and removes the wiper cassette, the wiper cassette may tilt more easily with the center of gravity, which is near the winding roller, as the center of rotation. Therefore, in comparison to a case in which the wiper cassette is pulled up vertically, the wiper cassette may be removed using less power.

It is preferable that in the wiper cassette, the power point acting portion be provided to extend in a direction intersecting the removal direction.

In this configuration since the power point acting portion is provided to extend in a direction intersecting the removal direction, for example, in comparison to a case in which the power point acting portion is provided to extend in the removal direction, favorable user operability may be achieved when removing the wiper cassette from the wiper holder.

It is preferable that the wiper cassette further include a locking portion which is locked to the wiper holder in a mounted state, in which the winding roller is positioned between the power point acting portion and the locking portion in a direction intersecting an axial direction of the winding roller.

In this configuration, the wiper cassette, in a state of being mounted in the wiper holder, is locked to the wiper holder via the locking portion. Therefore, it is possible to suppress the unintentional removal of the wiper cassette from the wiper holder due to a force which acts on the wiper cassette when wiping the liquid adhered to the liquid ejecting head or the like. Meanwhile, when removing the wiper cassette from the wiper holder, the locking portion is positioned such that the locking portion and the power point acting portion interpose the winding roller therebetween. Therefore, by tilting the wiper cassette via the power point acting portion, it is possible to easily release the fixing to the wiper holder by the locking unit.

It is preferable that the wiper cassette further include a reverse rotation suppression mechanism which suppresses rotation of the winding roller in a direction in which the wiping member is fed out.

In this configuration, since the wiping member which has already wiped the liquid is fed out from the winding roller, it is possible to suppress the occurrence of bending and the like of the wiping member. In other words, it is possible to suppress poor wiping caused by bending and the like of the wiping member.

It is preferable that in the wiper cassette, in an axial direction of the winding roller, the reverse rotation suppression mechanism be provided on an axial end portion of an opposite side from the axial end portion at which the winding gear is supported.

In this configuration, the reverse rotation suppression mechanism is provided on the opposite side from the axial end portion of the winding roller at which the winding gear is already supported. Therefore, it is possible to suppress a concentration of components of the wiper cassette at one of the axial end portions of the winding roller. Accordingly, it is possible to improve the ease of assembly and the maintainability of the wiper cassette.

It is preferable that in wiper cassette, the reverse rotation suppression mechanism include a rotating body which includes internal teeth which can be rotated integrally with the winding rollers, an external toothed gear which meshes with the internal teeth and can be rotated by rotation of the rotating body; and a non-rotatable body which is not rotatable in relation to the winding roller, in which the non-rotatable body includes a rotation permission portion which permits the rotation of the external toothed gear by allowing the external toothed gear to slide; and a rotation restriction portion which restricts the rotation of the external toothed gear by engaging the external toothed gear, and in which the rotating body includes a cover portion which covers the external toothed gear and the non-rotatable body from outside in the axial direction.

In this configuration, it is possible to adopt a configuration in which the non-rotatable body and the external toothed gear, which are the internal mechanism of the reverse rotation suppression mechanism, are covered using a cover portion and are not exposed to the outside of the wiper cassette. Therefore, it is possible to suppress contamination by foreign materials from the outside, and it is possible to raise the reliability of the reverse rotation suppression mechanism.

According to another aspect of the invention, there is provided a wiper unit which includes the wiper cassette described above; and the wiper holder, in which, in a mounted state, the wiper holder is movable in relation to the liquid ejecting head in a state in which the wiping member is caused to abut the liquid ejecting head.

In this configuration, by moving the wiper holder relative to the liquid ejecting head, the wiper unit can wipe the liquid which is adhered to the liquid ejecting head. In addition, when the wiping member is consumed, it is possible to continue using the wiper unit by exchanging the wiper cassette by detachment and attachment thereof.

According to still another aspect of the invention, there is provided a liquid ejecting apparatus which includes the wiper unit and the liquid ejecting head.

In this configuration, it is possible to obtain the same effect as achieved by the wiper cassette and the wiper unit described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description will be given below, with reference to the drawings, of an embodiment in which a wiper unit including a wiper cassette is installed in an ink jet printer, which is a type of liquid ejecting apparatus.

Figure 1:
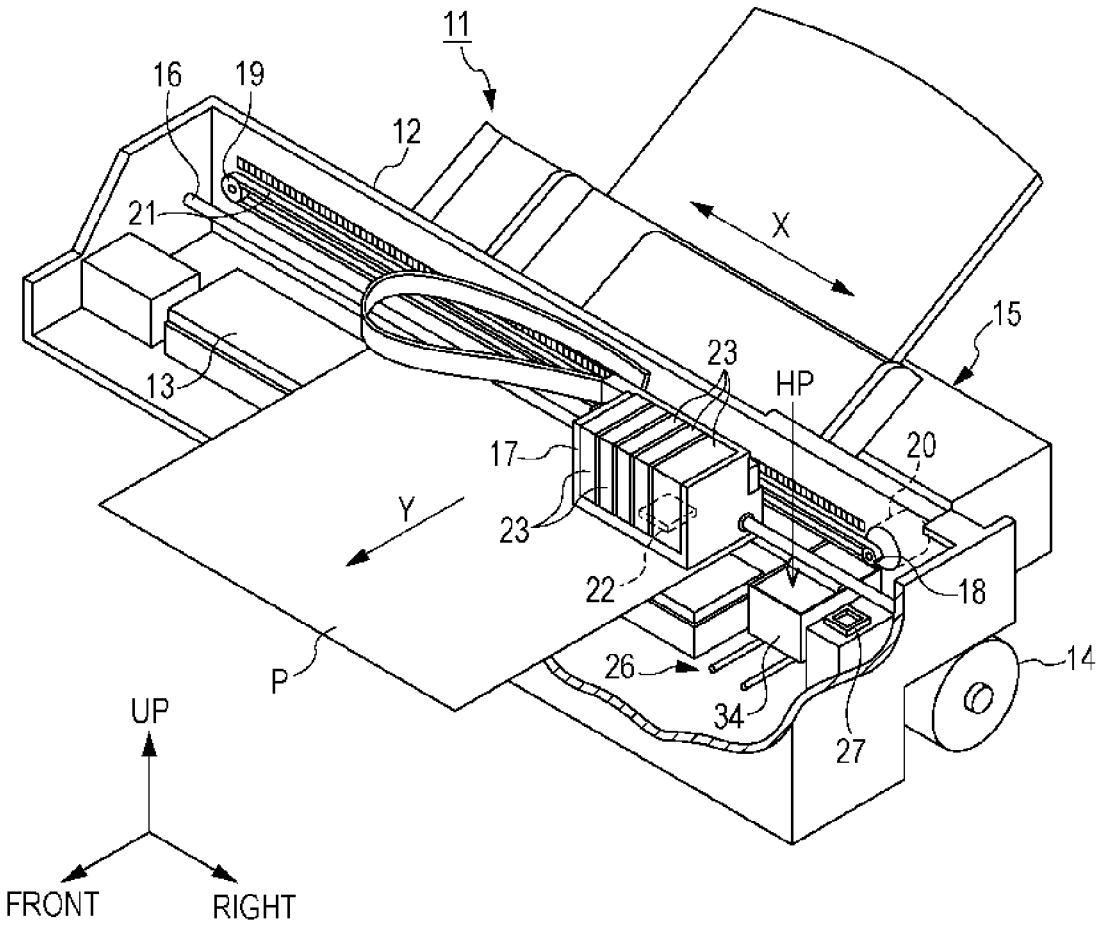
FIG. 1 is a perspective view of a printer of an embodiment.

As shown in FIG. 1, in a printer 11, a support member 13 of a substantially rectangular plate shape is provided on the lower portion of the inside of a frame 12 of a substantially rectangular box shape in a state in which the longitudinal direction of the support member 13 matches the main scanning direction X (the left-right direction in FIG. 1). On the support member 13, a recording paper P is fed out from the rear side in the sub-scanning direction Y (the front-back direction in FIG. 1) which intersects the main scanning direction X on the basis of the driving of a feed motor 14 which is provided on the lower portion of the rear surface of the frame 12. In addition, a guide shaft 16 of a rod shape which extends parallel to the longitudinal direction of the support member 13 is provided above the support member 13 in the frame 12. A carriage 17 is supported by the guide shaft 16 in a state of being reciprocally movable in the axial direction of the guide shaft 16.

On the inner surface of the rear wall of the frame 12, a drive pulley 18 and a driven pulley 19 are supported at each position corresponding to both ends of the guide shaft 16 in a freely rotatable state. The output shaft of a carriage motor 20, which serves as the drive source when causing the carriage 17 to move reciprocally, is connected to the drive pulley 18. In addition, an endless timing belt 21, a portion of which is connected to the carriage 17, is mounted between the pair of pulleys 18 and 19. Accordingly, while the carriage 17 is guided by the guide shaft 16, the carriage 17 is movable in the main scanning direction X via the endless timing belt 21 due to the driving force of the carriage motor 20.

A liquid ejecting head 22 is provided on the lower surface of the carriage 17. Meanwhile, a plurality of (in the present embodiment, four) ink cartridges 23 which store an ink (a liquid) to be supplied to a liquid ejecting head 22 are installed in an attachable and detachable manner to the carriage 17. In addition, the lower surface (the surface opposite the support member 13) of the liquid ejecting head 22 is a nozzle forming surface in which a plurality of nozzles (not shown) for ejecting ink droplets of each color are provided in a line along the front-back direction which intersects the main scanning direction X of the carriage 17. Furthermore, the ink droplets are ejected from the nozzles formed on the nozzle forming surface of the liquid ejecting head 22 onto the recording paper P, which is fed on the support member 13, thereby executing the recording in relation to the recording paper P.

In the frame 12, a head maintenance apparatus 26 for performing maintenance of the liquid ejecting head 22 is provided at a home position HP, which is provided on the right side of a recording region to which the recording paper P is transported. Furthermore, the head maintenance apparatus 26 includes a cap unit 27 which abuts the nozzle forming surface of the liquid ejecting head 22 when recording is not taking place and suppresses the evaporation of an ink solvent from the nozzles, and absorbs ink with an increased viscosity or the like from the nozzles, and a wiper unit 34 which is capable of wiping ink adhered to the nozzle forming surface of the liquid ejecting head 22.

Next, description will be given of the wiper unit 34 which is provided in the head maintenance apparatus 26.

Figure 2:
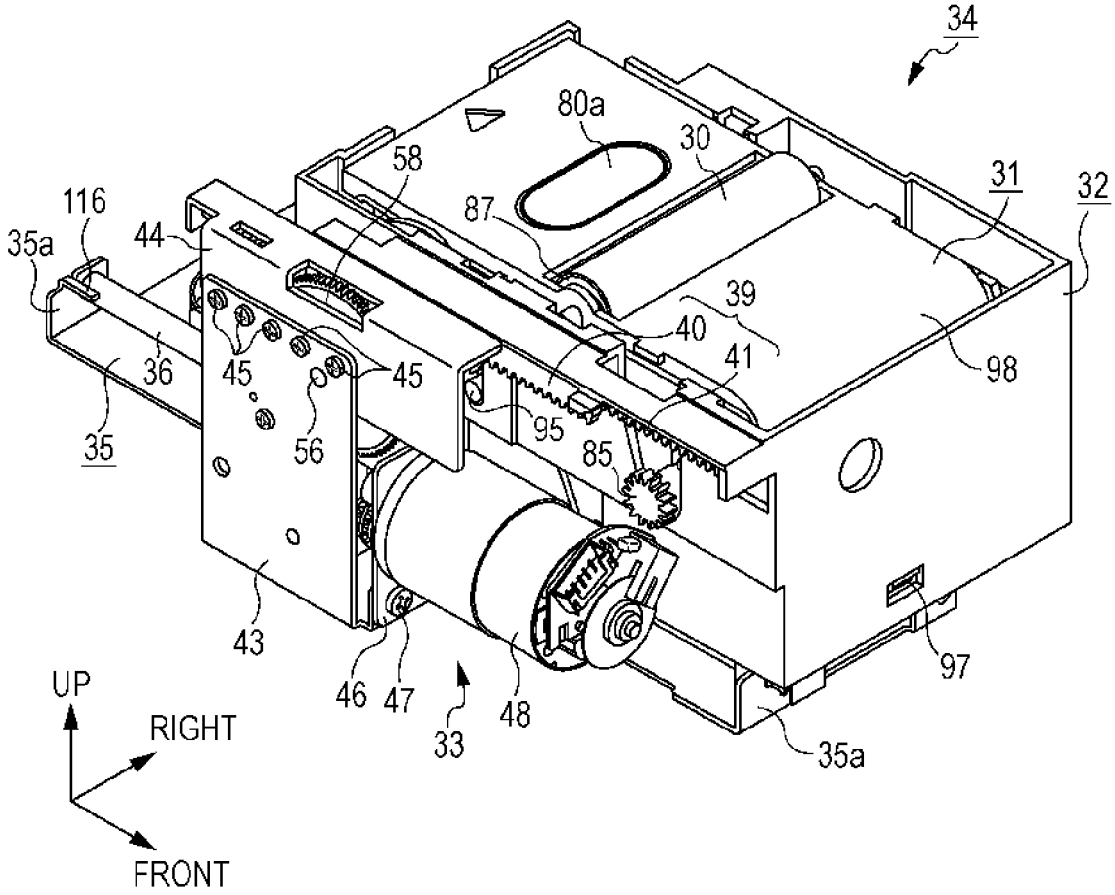
FIG. 2 is a perspective view of a wiper unit.
Figure 3:
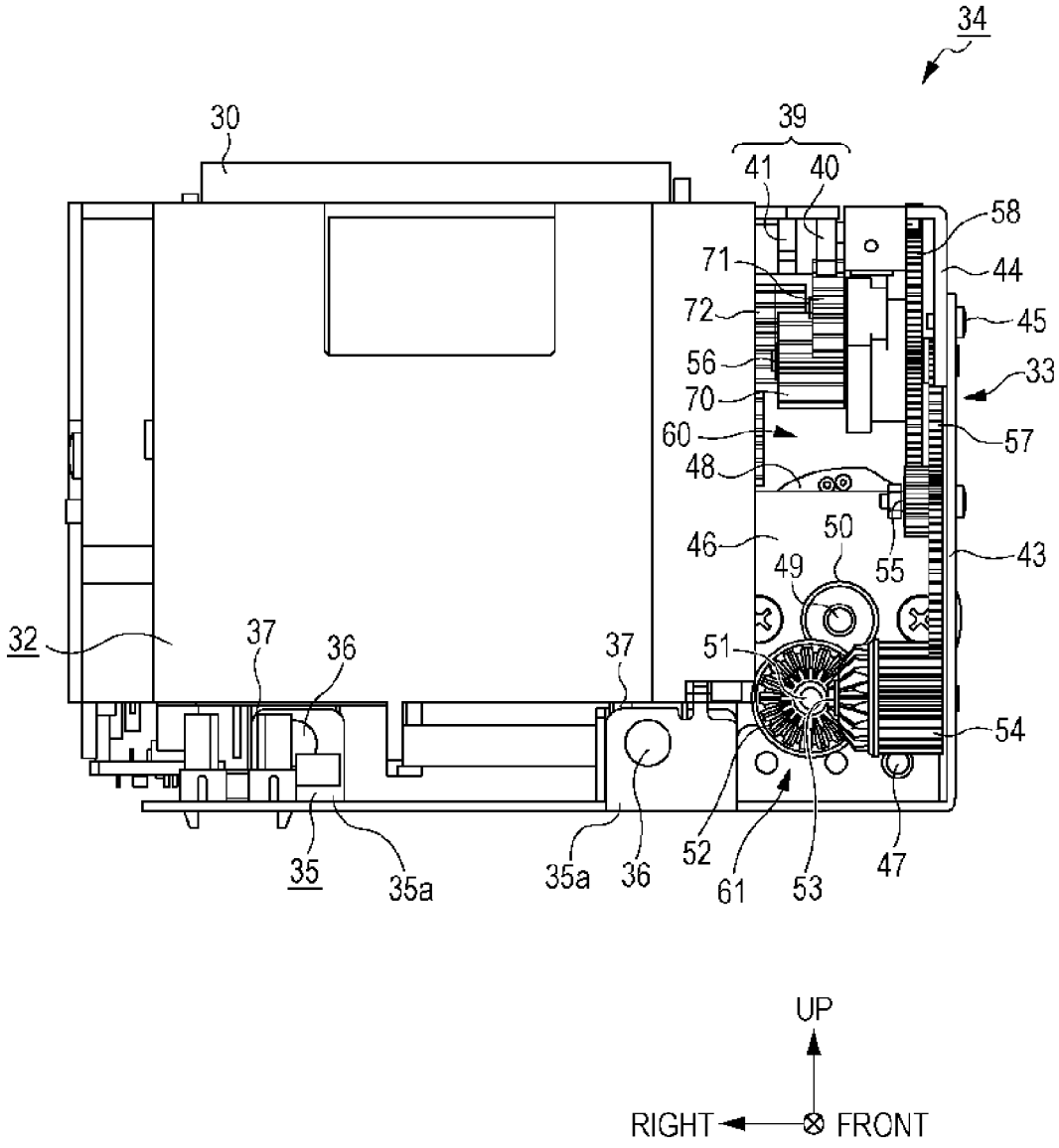
FIG. 3 is a rear view of the wiper unit.

As shown in FIGS. 2 and 3, the wiper unit 34 includes a wiper cassette 31 and a wiper holder 32. A wiping member 30 which wipes ink from the nozzle forming surface of the liquid ejecting head 22 is installed in the wiper cassette 31, and the wiper cassette 31 is mounted into the wiper holder 32 so as to be freely attachable and detachable. In addition, the wiper unit 34 includes a drive mechanism 33 which causes the wiper holder 32 to move in the front-back direction, which is the direction of the nozzle row of the liquid ejecting head 22.

As shown in FIG. 2, the wiper holder 32 is of a box shape to maintain the wiper cassette 31 therein in a attachable and detachable manner in the attachment-detachment direction (the up-down direction). A guide frame 35 is present beneath the wiper holder 32, fitted onto the inner surface of the base wall of the frame 12 in the printer 11 via a bracket (not shown). Opposing pieces 35*a*, which are in a pair on the left and right sides, are provided in the guide frame 35 at positions distanced from one another in the left-right direction. Each pair of the opposing pieces 35*a* is formed in two positions, which are distanced in the front-back direction, by being bent upward so as to oppose one another in the front-back direction. Furthermore, a guide shaft 36 which extends in the front-back direction is provided between each pair of the opposing pieces 35*a*. In addition, on the bottom surface of the wiper holder 32, bearing portions 37 (refer to FIG. 5) which are inserted into each of the guide shafts 36 in a slidable manner extend downward in the vertical direction. Furthermore, The bearing portions 37 make contact and slide in the axial direction in relation to the guide shafts 36, which are in a pair on the left and right sides. Therefore, the wiper holder 32 is supported such that the movement thereof in the front-back direction may be guided by the guide shaft 36.

As shown in FIG. 2, a rack gear portion 39 is provided in a position close to the top of the left wall portion of the wiper holder 32. The rack gear portion 39 is configured from a first rack gear portion 40 which extends in a straight line from a position near the front of the wiper holder 32 to a position near the rear, and a second rack gear portion 41 which extends in a straight line from a front end portion of the wiper holder 32 to a position near the rear. Furthermore, the first rack gear portion 40 is disposed in a position neighboring the second rack gear portion 41 on the left. In other words, both of the rack gear portions 40 and 41 are disposed in different positions to one another in the left-right direction. In addition, both of the rack gear portions 40 and 41 are disposed shifted in the front-back direction, which is the movement direction of the wiper holder 32, and partially overlap one another.

In addition, as shown in FIGS. 2 and 3, a support piece 43 is provided extending from the guide frame 35 in a substantially central position in the front-back direction of the left end portion of the guide frame 35. The front end side of the support piece 43 is bent upward in a substantially L-shaped manner. In addition, a support frame 44 is fixed to the upper end of the support piece 43 by a fixing screw 45. The upper end side of the support frame 44 is bent rightward toward the inside of the wiper holder 32 in a substantially L-shaped manner. In addition, a fitted frame 46 is fixed to the front end portion of the base end portion extending in the horizontal direction of the support piece 43 by a fixing screw 47, and a drive motor 48 which serves as the drive source of the drive mechanism 33 is supported via the fitted frame 46.

As shown in FIG. 3, an output gear 50 is provided so as to be integrally rotatable with an output shaft 49 of the drive motor 48. Furthermore, a bevel gear 52 supported by a shaft 51 meshes with an output gear 50 from below. In addition, a bevel gear 54 supported by a shaft 53 meshes with a bevel gear 52 positioned on the right thereof from the left. Furthermore, the bevel gear 54 meshes with a driven gear 58 such that power transmission can occur therebetween. The driven gear 58 is supported by a shaft 56 via a driven gear 57 which is supported by a gear 55. In addition, a planetary gear mechanism 60 is provided on the shaft 56. Furthermore, in the present embodiment, a power transmission mechanism 61 which transmits power output from the drive motor 48 to the planetary gear mechanism 60 is configured by the shafts 51, 53, 55 and 56, the bevel gears 52 and 54, and the driven gears 57 and 58.

Figure 4:
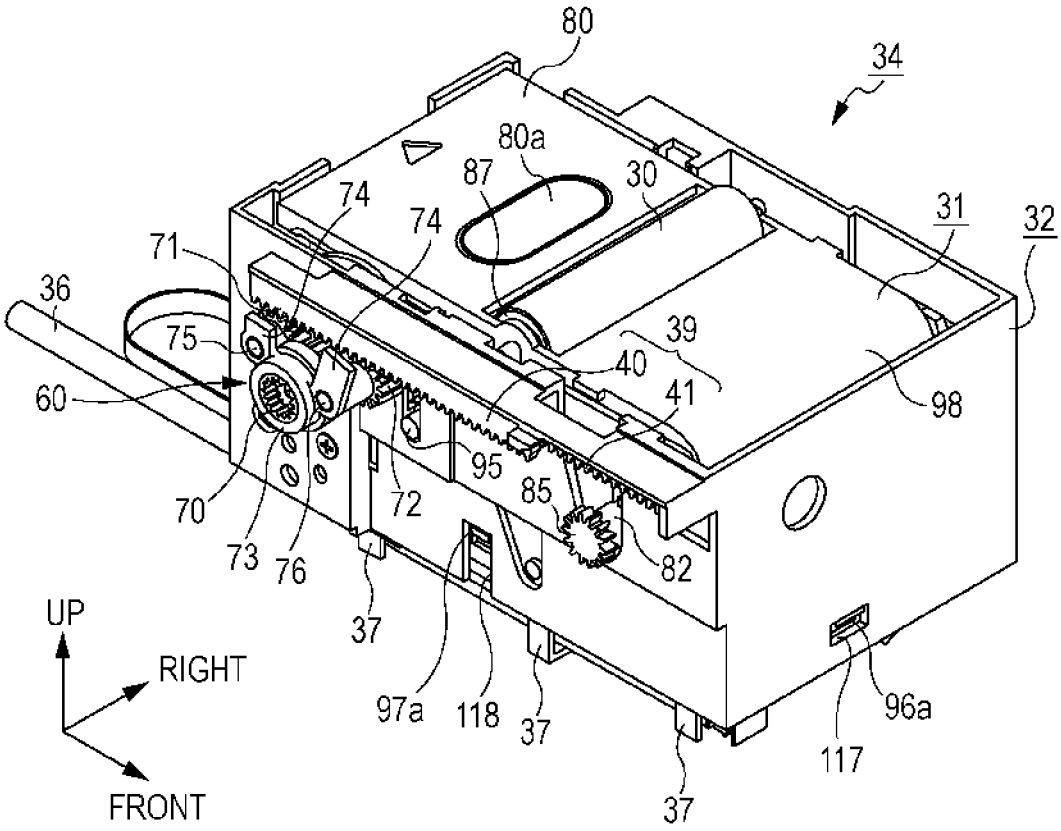
FIG. 4 is a perspective view of the wiper unit with a portion of the configuration omitted.
Figure 5:
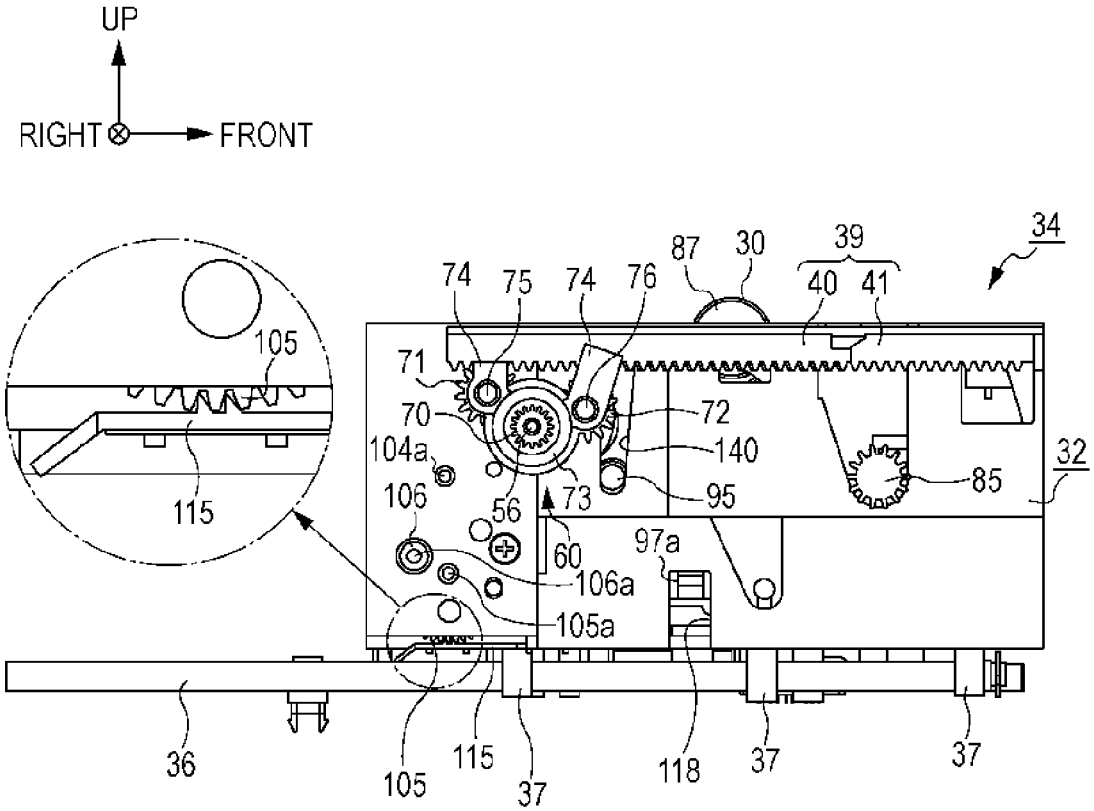
FIG. 5 is a side view of the wiper unit shown in FIG. 4.

The FIGS. 4 and 5 show the wiper unit 34, with the drive motor 48, the power transmission mechanism 61, the support frame 44 and the guide frame 35 omitted. Furthermore, as shown in FIGS. 4 and 5, the planetary gear mechanism 60 includes a sun gear 70, a plurality of (two, in the present embodiment) planetary gears 71 and 72 which rotate around the circumference of the sun gear 70, and a base member 73 which rocks while supporting the planetary gears 71 and 72 in a freely rotatable manner.

The base member 73 is of a substantially letter V shape when viewed from the side such that a pair of arm portions 74 protrude so as to split from the base end portion. In addition, the base member 73 is supported in a freely rotatable manner by the shaft 56, the base end portion of which serves as the axis of rotation of the sun gear 70. In addition, on the pair of arm portions 74 formed on the base member 73, the planetary gears 71 and 72 are supported via each of corresponding shafts 75 and 76 in a freely rotatable manner.

Furthermore, the planetary gears 71 and 72 are disposed in different positions from one another in the axial direction of the shaft 56. Specifically, of the planetary gears 71 and 72, the planetary gear 71 of one side (the rear side in FIGS. 4 and 5) is disposed in the same position as the first rack gear portion 40 in the axial direction of the shaft 56, and the planetary gear 72 of the other side (the front side in FIGS. 4 and 5) is disposed in the same position as the second rack gear portion 41 in the axial direction of the shaft 56. Furthermore, as shown in FIGS. 4 and 5, when the first rack gear portion 40 is positioned above the sun gear 70 in the vertical direction, the first rack gear portion 40 is positioned on the moving path of the planetary gear 71 which rotates around the circumference of the sun gear 70. Meanwhile, when the wiper holder 32 moves rearward along the guide shaft 36 from the state shown in FIGS. 4 and 5, and the second rack gear portion 41 is positioned above the sun gear 70 in the vertical direction, the second rack gear portion 41 is positioned on the moving path of the planetary gear 72 which rotates around the circumference of the sun gear 70.

Furthermore, when the power output from the drive motor 48 is transmitted to the sun gear 70 of the planetary gear mechanism 60 through the power transmission mechanism 61, each of the planetary gears 71 and 72 of the planetary gear mechanism 60 rotate around the circumference of the sun gear 70 on the basis of the driving force transmitted from the sun gear 70. As a result, each of the planetary gears 71 and 72 meshes respectively with the corresponding rack gear portions 40 and 41, such that power transmission can occur therebetween. In this case, the power output from the drive motor 48 is transmitted as a force which causes the wiper holder 32 to move in the front-back direction, which is the axial direction of the guide shaft 36. Here, in the present embodiment, the drive mechanism 33 which causes the wiper holder 32 to move in the front-back direction, which is the direction of the nozzle row of the liquid ejecting head 22, is configured by the drive motor 48, the power transmission mechanism 61 and the planetary gear mechanism 60. In other words, the drive mechanism 33 is capable of causing the wiper holder 32 to move relative to the liquid ejecting head 22 in a state in which the wiping member 30 is caused to abut the liquid ejecting head 22.

Figure 6A:
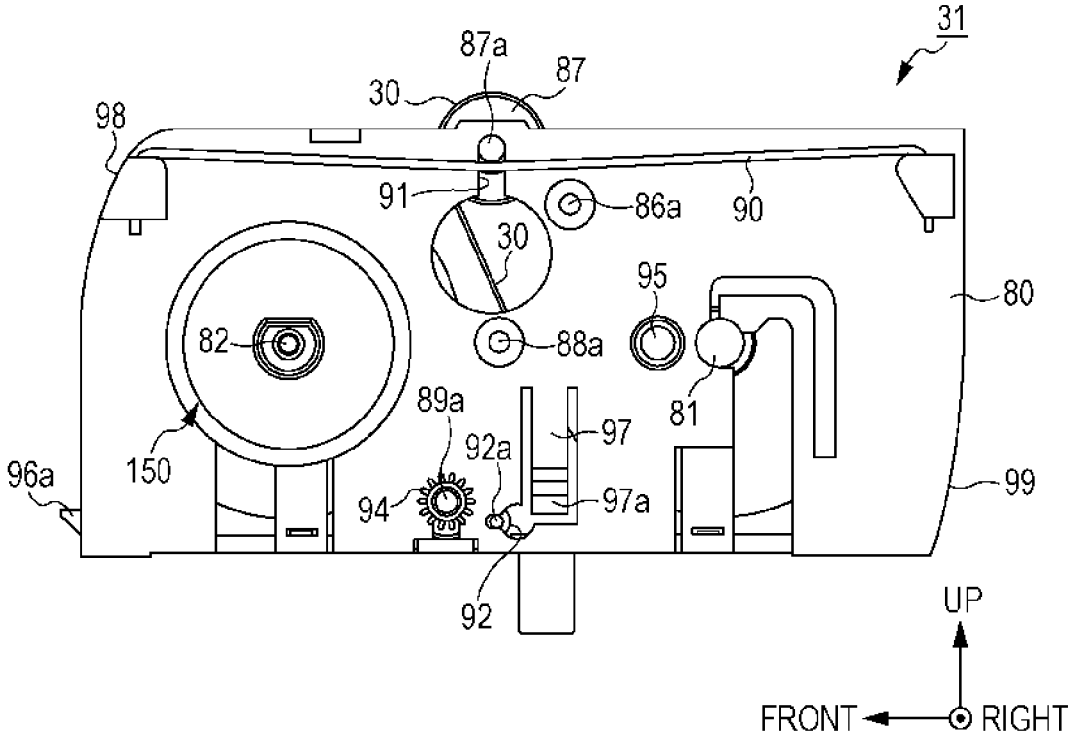
FIG. 6A is a side view of a wiper cassette.
Figure 6B:
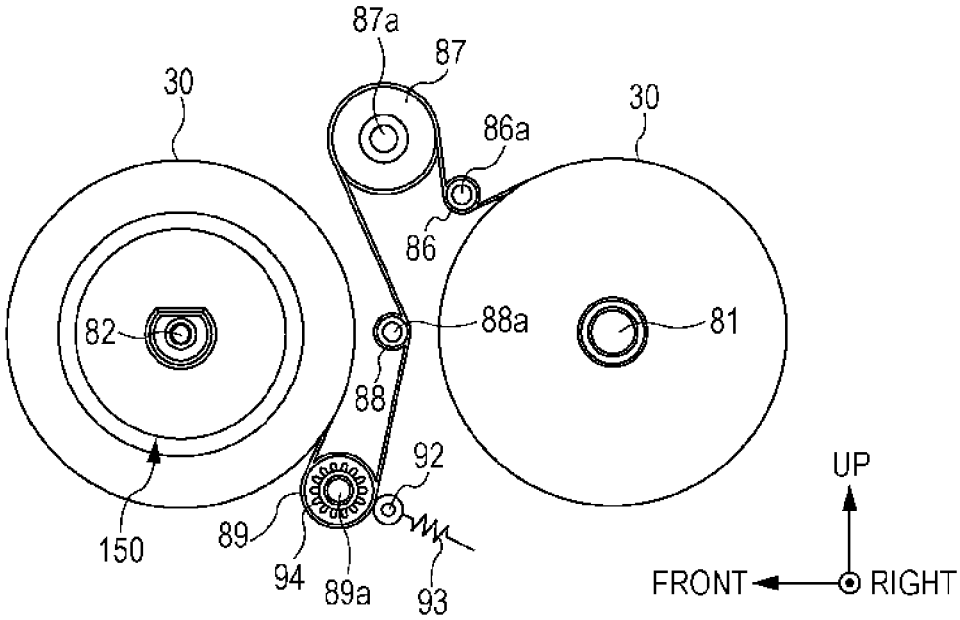
FIG. 6B is a side view of the wiper cassette with the housing omitted.

As shown in FIGS. 6A and 6B, inside of a housing 80 of a substantially rectangular box shape which configures the packaging of the wiper cassette 31, a pair of rollers 81 and 82 which have an axial line extending horizontally in the left-right direction, which is the short direction of the housing 80 is accommodated. The rollers 81 and 82 are accommodated so as to be distanced from one another in the front-back direction, which is the longitudinal direction of the housing 80. The long wiping member 30 for wiping the ink from the nozzle forming surface of the liquid ejecting head 22 is mounted between the pair of rollers 81 and 82. Furthermore, of the pair of rollers 81 and 82, the feed roller 81, which is provided on the rear side, is configured to be capable of feeding out the unused wiping member 30 wound therearound. Meanwhile, of the pair of rollers 81 and 82, the winding roller 82, which is provided on the front side, is configured to be capable of winding the used wiping member 30 therearound, where the used wiping member 30 is unwound from the feed roller 81 and used for wiping. Furthermore, the feed roller 81 and the winding roller 82 are positioned at approximately the same height.

In addition, a feed gear 83 (refer to FIG. 8) is provided on the axial end portion (the left side axial end portion) of the axial direction of the feed roller 81 which is exposed to the outside of the housing 80, so as to be integrally rotatable with the feed roller 81. In addition, a winding gear 85 (refer to FIG. 8) is provided on the axial end portion (the left side axial end portion) in the axial direction of the winding roller 82 which is exposed to the outside of the housing 80, so as to be integrally rotatable with the winding roller 82. Furthermore, in the axial direction of the winding roller 82, a reverse rotation suppression mechanism 150, which restricts the rotation direction of the winding roller 82 to one direction, is provided on an axial end portion 82*a* (refer to FIG. 12) of the opposite side from the axial end portion at which the winding gear 85 is supported.

In addition, a plurality (four in the present embodiment) of rollers 86, 87, 88 and 89 are provided on the feed path of the wiping member 30 which spans from the feed roller 81 to the winding roller 82 inside of the housing 80. The rollers 86, 87, 88 and 89 extend in the left-right direction in parallel with the feed roller 81 and the winding roller 82, and the left and right end portions thereof are supported by a bearing portion or the like which is provided on the side wall portion of the housing 80 so as to be freely rotatable.

Specifically, a portion of the wiping member 30 which is fed out from the feed roller 81 is wound around a pressing roller 87 which is provided in front of and above the feed roller 81. A shaft portion 87*a* of both ends in the axial direction of the pressing roller 87 is supported from below by a torsion bar 90 which is fixed to the outside surfaces of both sides left and right of the housing 80. The torsion bar 90 supports the shaft portion 87*a* of the pressing roller 87 at a central position in the longitudinal direction thereof from below. Furthermore, the shaft portion 87*a* of the pressing roller 87 is inserted through, in the left-right direction, a bearing hole 91 provided in the housing 80. The shaft portion 87*a* of the pressing roller 87 is in close contact with the edge of the hole of the upper side of the bearing hole 91 according to the upward force applied thereto from the torsion bar 90. Furthermore, the shaft portion 87*a* of the pressing roller 87 is supported from both above and below between the torsion bar 90 and the edge of the bearing hole 91 so as to be freely rotatable. In addition, the uppermost portion of the peripheral surface of the pressing roller 87 is positioned further up than the upper surface of the housing 80, and the portion of the wiping member 30 which is wound around the pressing roller 87 protrudes upward from the upper surface of the housing 80. In addition, the uppermost portion of the peripheral surface of the pressing roller 87 is positioned further up than the nozzle forming surface of the liquid ejecting head 22.

In addition, an relay roller 89, around which a portion of the wiping member 30 which is fed out from the pressing roller 87 is wound, is provided in the vertical direction of (below) the pressing roller 87. The relay roller 89 is configured to be capable of being rotated together with the feeding out of the wiping member 30 from the feed roller 81 to the winding roller 82. In addition, a pinching roller 92 which pinches the wiping member 30 between the relay roller 89 and itself is provided in a position of the opposite side from the relay roller 89 with the wiping member 30 pinched therebetween. In addition, a spring member 93, which serves as a biasing member, is provided between the lower wall inner surface of the housing 80 and the pinching roller 92. Furthermore, a force is applied to the pinching roller 92 in a direction causing the pinching roller 92 to contact the relay roller 89 by the spring member 93.

In addition, a relay gear 94 is provided on the end portion of a shaft portion 89*a* on one side (the right side in FIGS. 6A and 6B) of the axial direction of the relay roller 89 so as to be integrally rotatable with the relay roller 89. In addition, a shaft portion 92*a* of both sides in the axial direction of the pinching roller 92 is supported by a bearing portion. The bearing portion is of a notch structure which is formed by cutting out an elastic piece on the side wall portion of the housing 80.

In addition, the tension rollers 86 and 88 which apply tension to the wiping member 30 are provided between the feed roller 81 and the pressing roller 87, and between the pressing roller 87 and the relay roller 89 on the feed path of the wiping member 30 which spans from the feed roller 81 to the winding roller 82. Furthermore, shaft portions 86*a* and 88*a* of both sides in the axial direction of the tension rollers 86 and 88 are supported by a circular, concave bearing portion which is provided on the side wall portion of the housing 80.

Figure 7:
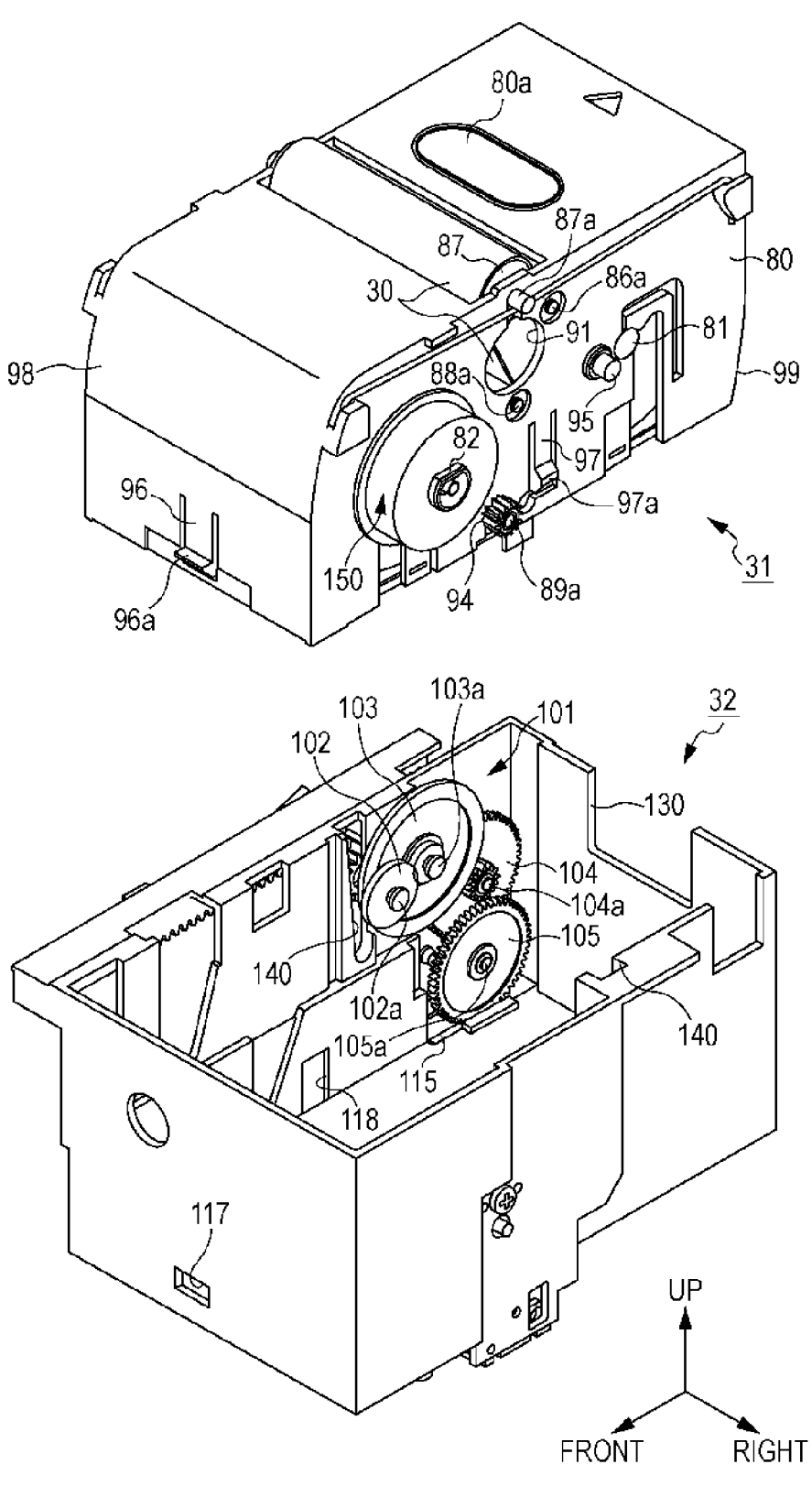
FIG. 7 is a perspective view of the wiper cassette in a state of being removed upward from the wiper holder, as seen from the upper side of the front-right.

In addition, as shown in FIG. 7, substantially cylindrical engaging protrusions 95 are provided on both left and right side surfaces of the housing 80 so as to protrude horizontally in the left-right direction. The engaging protrusions 95 are positioned near the rear of the housing 80, which is closer to the feed roller 81 side than the central position of the front-back direction. Furthermore, the engaging protrusions 95 are formed in a substantially central position in the height direction of the housing 80.

In addition, an elastic piece 96 is formed in a position near the bottom of the front side surface of the housing 80. The upper end side of the elastic piece 96 is a fixed end in relation to the housing 80, and the lower end side is a free end. The elastic piece 96 is elastically deformable in the front-back direction, with the fixed end of the upper end side as the fulcrum. Furthermore, a locking tab 96*a* which serves as the locking portion, which is substantially triangular when viewed from the side in the left-right direction, is formed on the lower end side which is the free end of the elastic piece 96.

Figure 8:
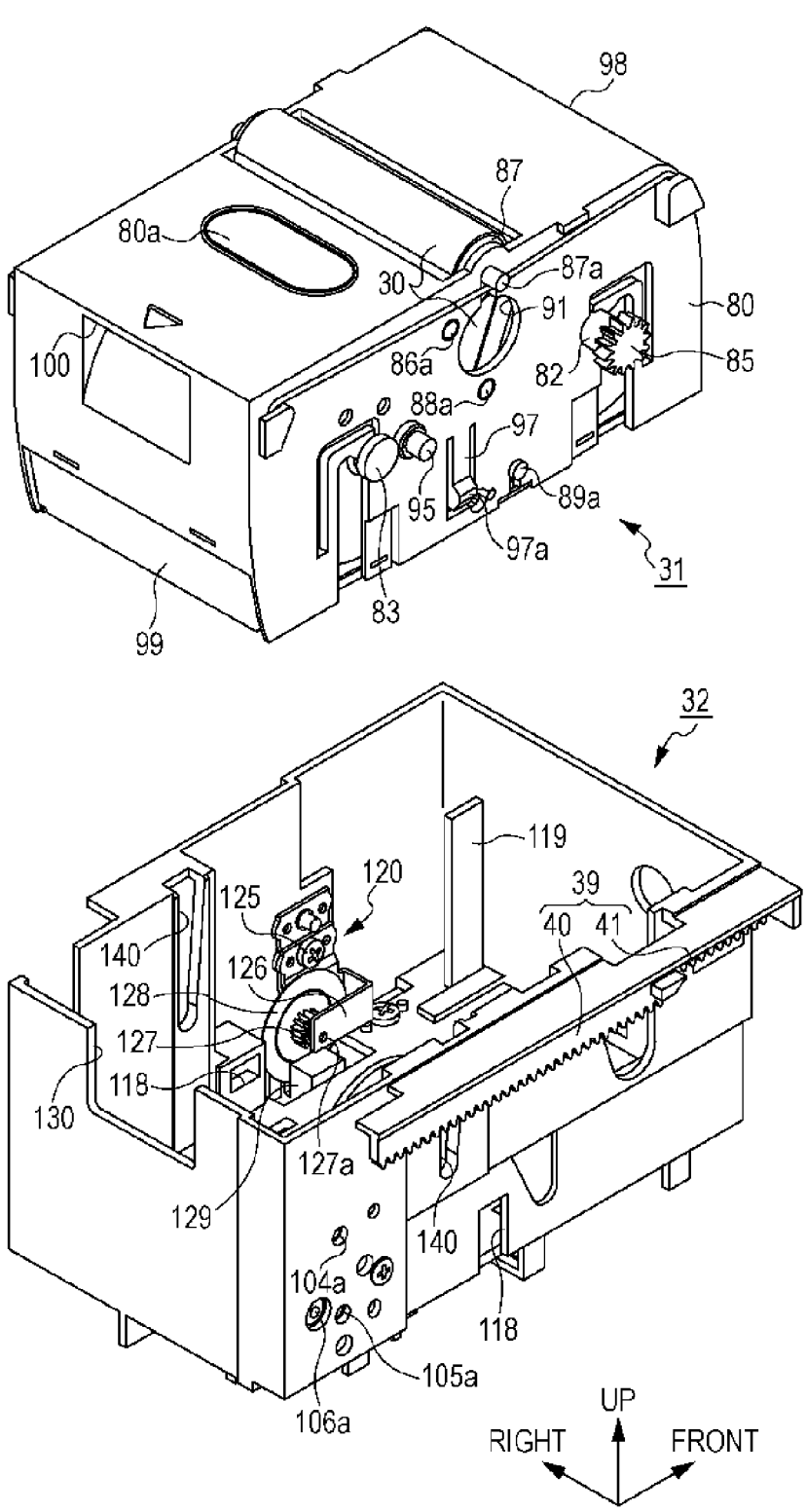
FIG. 8 is a perspective view of the wiper cassette in a state of being removed upward from the wiper holder, as seen from the upper side of the rear-left.

In the same manner, as shown in FIGS. 7 and 8, an elastic piece 97 is formed at a position near the bottom of both the left and right side surfaces of the housing 80. The upper end side of the elastic piece 97 is a fixed end in relation to the housing 80, and the lower end side is a free end. The elastic piece 97 is elastically deformable in the left-right direction, with the fixed end of the upper end side as the fulcrum. Furthermore, a locking tab 97*a*, which is substantially triangular when viewed from the side in the front-back direction, is formed on the lower end side which is the free end of the elastic piece 97.

In addition, as shown in FIGS. 7 and 8, curved surfaces 98 and 99 are formed on an upper portion of the front side surface and on a lower portion of the rear side surface, respectively, in relation to the housing 80. Furthermore, the curved surfaces 98 and 99 are curved in a substantially arc shaped manner which is convex toward the outside of the housing 80. The curved surfaces 98 and 99 are withdrawn further to the inside than the other portions on the outside surface of the housing 80. Furthermore, a finger grip portion 100 is provided in a position near to the top of the rear side surface of the housing 80 so as to be concave toward the inside of the housing 80. The finger grip portion 100 serves as the power point acting portion on which a load acts in the removal direction when gripped by the user with the ends of the fingers of the user when the wiper cassette 31 is removed from the wiper holder 32. Furthermore, the finger grip portion 100 is provided to extend in the front-back direction which intersects the upward direction, which is the removal direction from the wiper holder 32.

Furthermore, in the present embodiment, in relation to the other components, the finger grip portion 100 is disposed as described below. In other words, as shown in FIG. 8, the finger grip portion 100 is positioned on the upper side of the wiper cassette 31, which is the side closer to the removal direction than the winding gear 85, in a mounted state in which the wiper cassette 31 is mounted into the wiper holder 32. In addition, as shown in FIGS. 7 and 8, the finger grip portion 100 is positioned on the upper side of the wiper cassette 31 in the mounted state described above, which is the side closer to the removal direction than the relay gear 94. In addition, the feed roller 81 is positioned between the winding roller 82 and the finger grip portion 100 in an axial intersection direction (the front-back direction in the present embodiment) which is a direction between the feed roller 81 and the winding roller 82. Furthermore, the winding roller 82 is positioned between the finger grip portion 100 and the locking tab 96*a* (refer to FIGS. 14A, 14B and 14C) in the front-back direction intersecting the axial direction of the winding roller 82 and the up-down direction.

In addition, as shown in FIGS. 7 and 8, a pressing surface 80*a* which is formed so as to be slightly indented from the upper surface of the housing is formed on the read side of the pressing roller 87 on the upper surface of the housing 80. The pressing surface 80*a* is a portion which is pressure operated when mounting the wiper cassette 31 into the wiper holder 32.

As shown in FIG. 7, a gear group 101 is provided at a position close to the rear end of the inside surface of the left wall portion of the wiper holder 32 so as to correspond to the feed roller 81 of the wiper cassette 31 which is mounted thereto. In addition, the gear group 101 is linked to the feed gear 83 such that power transmission can occur therebetween. The gear group 101 includes a plurality of (five in the present embodiment) driven gears 102, 103, 104, 105 and 106 (refer to FIG. 5). Furthermore, the four driven gears 102, 103, 104 and 105 which configure the gear group 101 are shown in FIG. 7. However, a driven gear 106 which meshes with the driven gear 104 and the driven gear 105 is hidden behind (the left side) the driven gear 105, and is therefore not shown. The driven gears 104, 105 and 106 of the gear group 101 are respectively supported, in a freely rotatable manner, by corresponding shafts 104*a*, 105*a* and 106*a* (refer to FIG. 5) which are inserted through and supported by the left wall portion of the wiper holder 32. The driven gears 102 and 103 are supported by the shafts 102*a* and 103*a* which are provided in the wiper cassette 31. Furthermore, the neighboring gears mesh such that power transmission can occur therebetween. Furthermore, the feed gear 83 and the driven gear 102 mesh with one another and the drive force is transmitted to the driven gear 105. The base end side of the driven gear 105 engages with a ratchet 115 (refer to FIG. 5) which is cantilevered by the bottom wall portion of the wiper holder 32.

As shown in FIG. 5, the toothed portion formed on the front end side of the ratchet 115 meshes with the driven gear 105 from below. Furthermore, when the driven gear 105 rotates in one rotation direction (a clockwise direction when viewed from the left) centered on the shaft 105*a*, the ratchet 115 elastically deforms in a direction away from the driven gear 105 with the cantilevered base end side as the fixed end, on the basis of a force acting thereon from the driven gear 105. As a result, the driven gear 105 is released from the engaged state, and the rotation of the driven gear 105 is permitted. Meanwhile, when the driven gear 105 rotates in the other rotation direction (a counter-clockwise direction when viewed from the left) centered on the shaft 105*a*, the ratchet 115 restricts the rotation of the driven gear 105 by maintaining an engaged state in relation to the driven gear 105, even if a force from the driven gear 105 acts on the ratchet 115. Furthermore, the ratchet 115 restricts the rotation of the driven gear 105, and the rotation of the feed roller 81, which is linked to the driven gear 105 such that force transmission can occur therebetween, is also restricted. Specifically, the rotation of the feed roller 81 is restricted in the counter-clockwise direction when viewed from the left side. The counter-clockwise direction is the direction in which the wound wiping member 30 is fed out. Furthermore, as shown in FIG. 2, a protruding piece 116 which protrudes toward the ratchet 115 side is formed on the rear end portion of the guide frame 35 in a position opposing the ratchet 115 in the front-back direction, which is the movement direction of the wiper holder 32.

In addition, as shown in FIG. 7, a locking hole 117 is formed through the lower side of the front wall portion of the wiper holder 32 in a position which corresponds to the locking tab 96*a* of the wiper cassette 31. In addition, as shown in FIGS. 7 and 8, locking holes 118 are formed in the lower sides of the side wall portion of both the left and right sides of the wiper holder 32 in a position which corresponds to the locking tab 97*a* of the wiper cassette 31. Furthermore, when the wiper cassette 31 is mounted into the wiper holder 32, the locking tabs 96*a* and 97*a* of the wiper cassette 31 are locked into the locking holes 117 and 118 of the wiper holder 32. Accordingly, the wiper cassette 31 is mounted into the wiper holder 32 in a stable state.

As shown in FIG. 8, a standing rib 119 is provided on the front wall portion of the wiper holder 32. The standing rib 119 is of a substantially rectangular plate shape which extends toward the inside (the rear side) of the wiper holder 32. The upper end of the standing rib 119 is lower than the upper end of the front wall portion of the wiper holder 32. Furthermore, the standing rib 119 is provided in order to restrict the movement of the wiper cassette 31 in the left-right direction when the wiper cassette 31 is mounted into the wiper holder 32.

Figure 9:
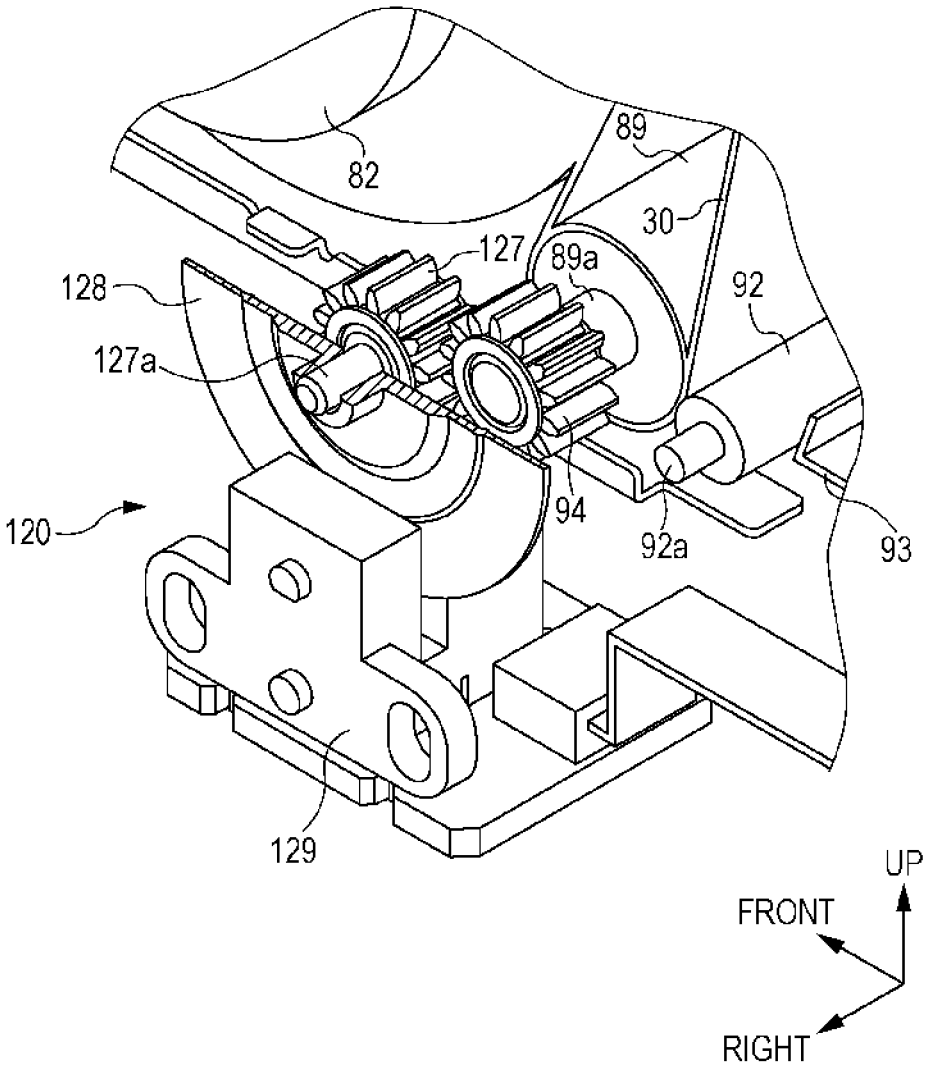
FIG. 9 is a perspective partial cross-section view showing the schematic configuration of a rotation amount detection unit.

In addition, as shown in FIGS. 8 and 9, a rotation amount detection unit 120 for detecting the feeding amount of the wiping member 30 is provided on the inside surface of the right wall portion of the wiper holder 32 in a position corresponding to the relay gear 94 of the wiper cassette 31 when the wiper cassette 31 is mounted into the wiper holder 32.

The rotation amount detection unit 120 includes a maintaining frame 126 which is fixed to the right wall portion of the wiper holder 32 by a fixing screw 125, and a shaft 127*a* which is supported by the maintaining frame 126 in a rotatable manner. In addition, as shown in FIG. 9, the rotation amount detection unit 120 includes a detection gear 127 which meshes with the relay gear 94 provided on the wiper cassette 31 side, a slit plate 128 which rotates with the detection gear 127, and a rotary encoder 129 which can detect the rotation amount of the slit plate 128. Furthermore, the detection gear 127 and the slit plate 128 are supported in an integrally rotatable manner by the shaft 127*a*, the axial direction of which is the left-right direction. In this manner, the rotation amount detection unit 120 detects the rotation amount of the slit plate 128 using the rotary encoder 129. Therefore, it is possible to indirectly detect the rotation amount of the relay roller 89.

In addition, as shown in FIGS. 7 and 8, a concave portion 130, which is a notch portion, is formed in the rear wall portion of the wiper holder 32 in a position corresponding to the finger grip portion 100 of the wiper cassette 31. The concave portion 130 is provided as a concave from the upper end to the lower end of the rear wall portion of the wiper holder 32. Furthermore, the finger grip portion 100 of the wiper cassette 31 which is mounted into the wiper holder 32 is exposed to the outside of the wiper holder 32 via the concave portion 130.

In addition, engaging concave portions 140 are provided on the side wall portion of both the left and right sides of the wiper holder 32 in positions which correspond to the engaging protrusions 95 of the wiper cassette 31 in the left-right direction. The engaging concave portions 140 extend from the upper end of the side wall portion of both the left and right sides of the wiper holder 32 to a substantially central position in the height direction in the side wall portions of both the left and right sides of the wiper holder 32, in the up-down direction, which is the attaching and detaching direction of the wiper cassette 31. The engaging concave portions 140 are configured such that the length dimensions thereof in the front-back direction of the opening of the upper side are set slightly larger than the diameter of the engaging protrusions 95. In addition, the length dimensions get progressively smaller toward the lower side.

Figure 10:
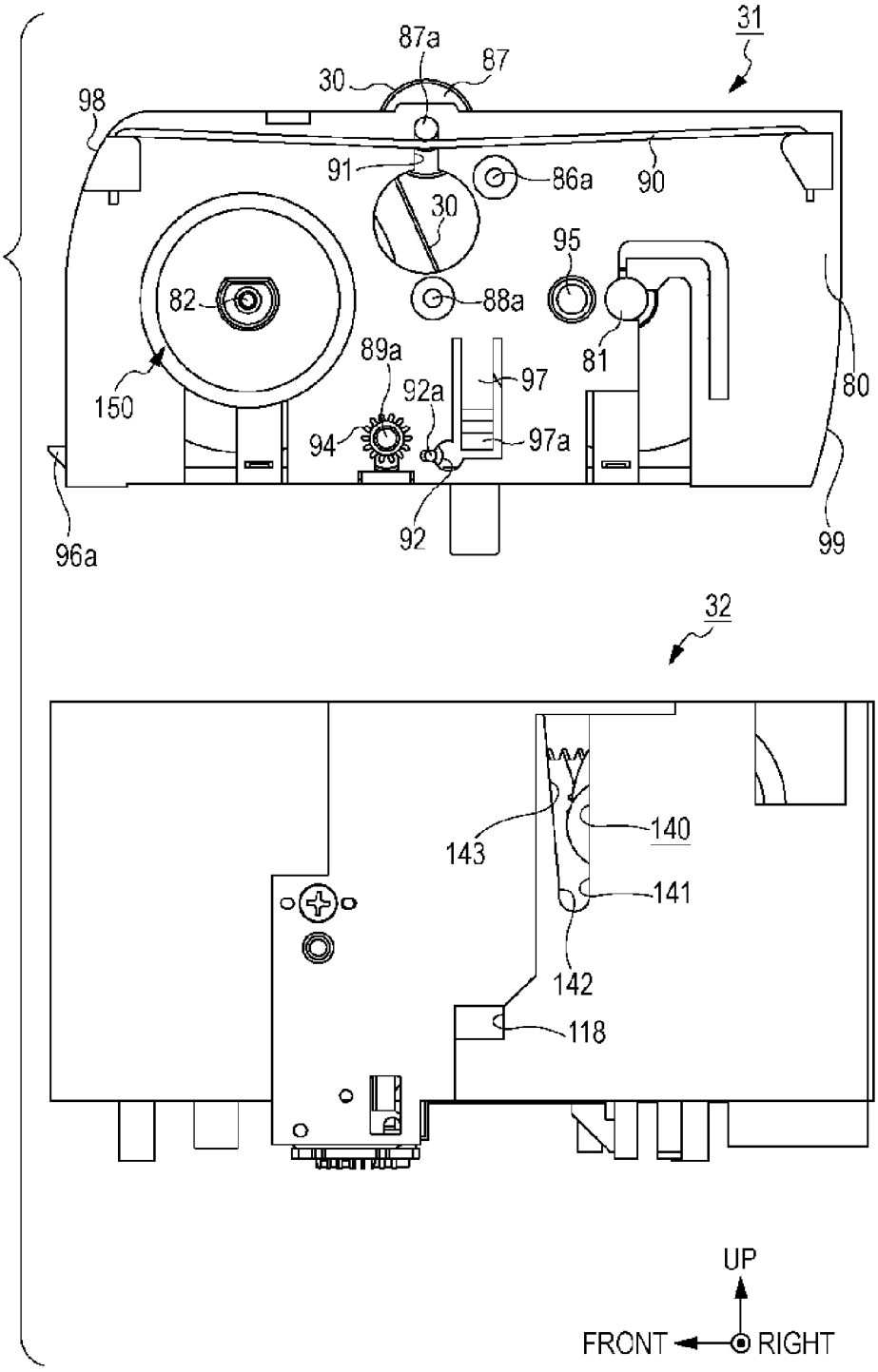
FIG. 10 is a side view of the wiper cassette in a state of being removed upward from the wiper holder.

Specifically, as shown in FIG. 10, the inside surface of the rear side of the engaging concave portion 140 is configured by a vertical surface 141 which extends in a straight line in the vertical direction. Meanwhile, the inside surface opposing the vertical surface 141 in the engaging concave portion 140 is configured such that the bottom end is formed by a vertical surface 142 which extends in a straight line in the vertical direction, and the upper portion is formed by an inclined surface 143 which is inclined in relation to the vertical direction so as to be a rising gradient in a forward direction distancing from the vertical surface 141. Furthermore, the length dimension in the front-back directions of the left and right vertical surfaces 141 and 142 positioned on the bottom end of the engaging concave portion 140 are approximately the same as the diameter of the engaging protrusions 95.

Next, description will be given of the reverse rotation suppression mechanism 150 which suppresses the rotation of the winding roller 82 in the direction in which the wiping member 30 is fed out therefrom.

Figure 11:
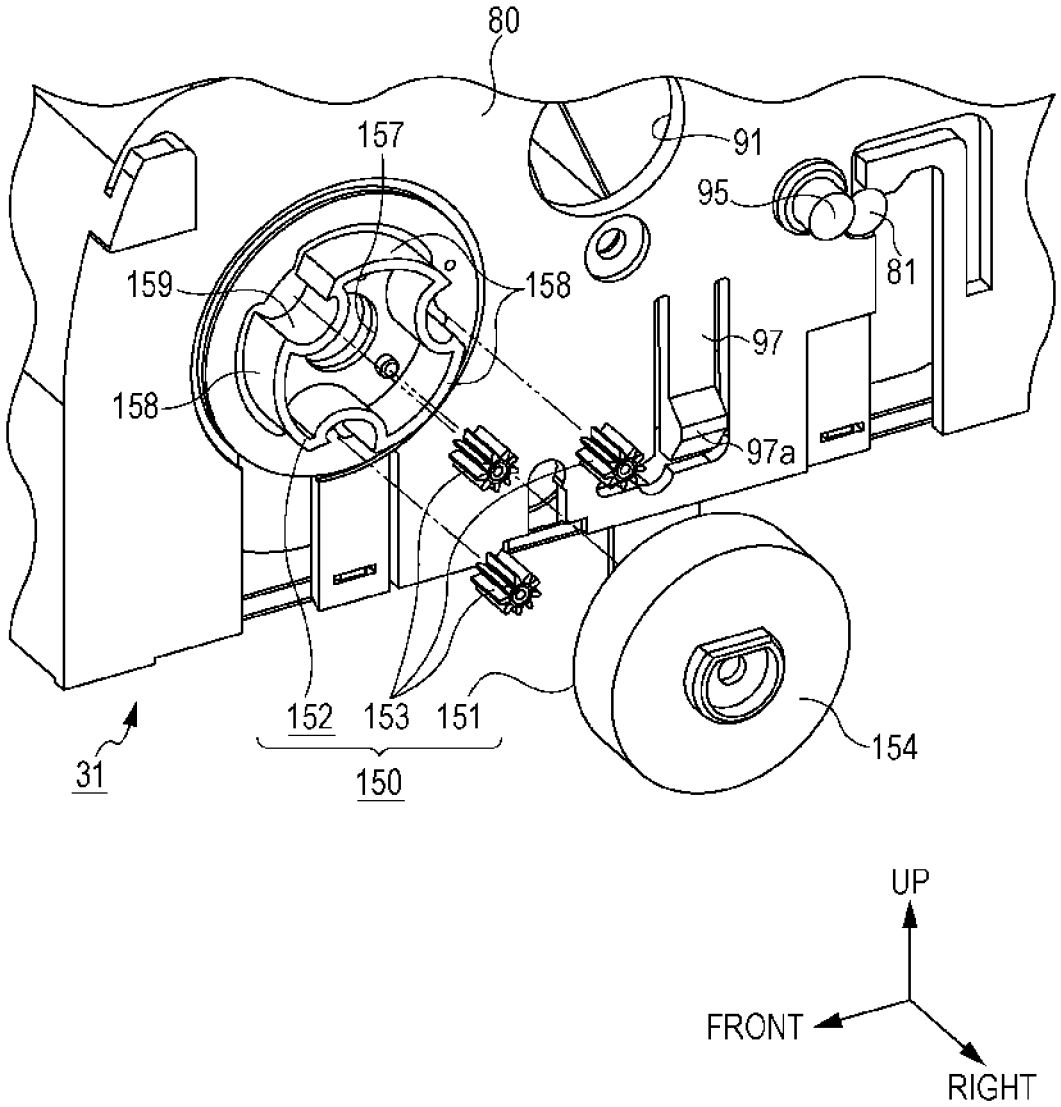
FIG. 11 is an exploded perspective view showing the schematic configuration of the reverse rotation suppression mechanism.
Figure 12:
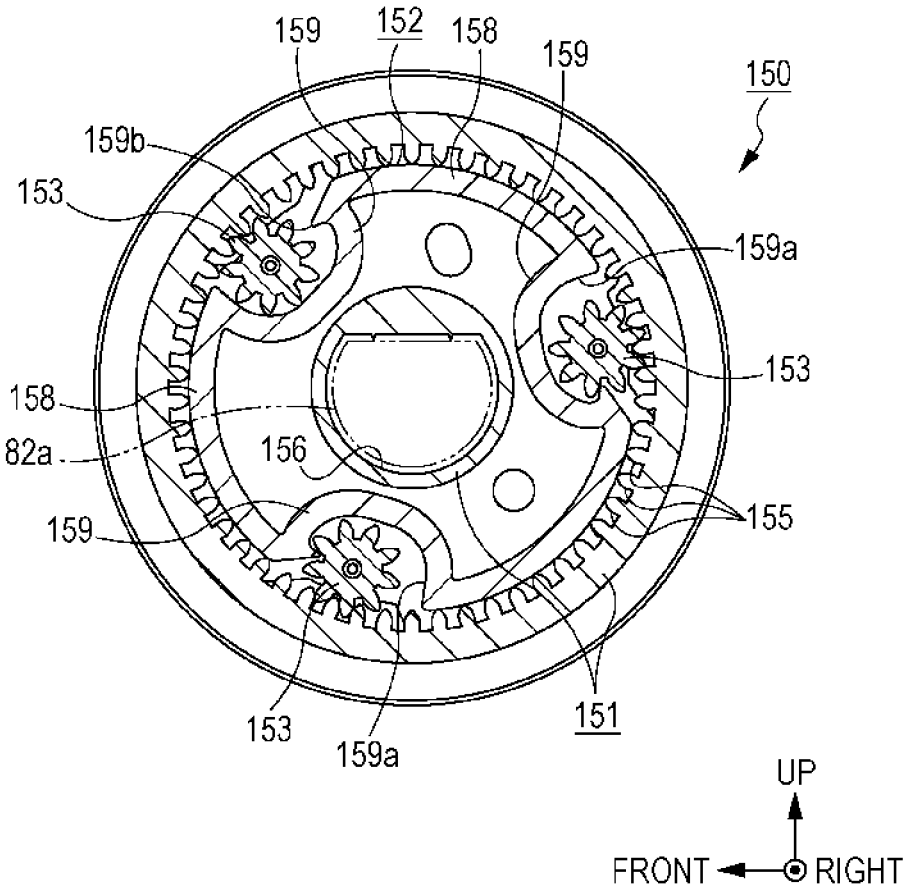
FIG. 12 is cross-section view showing the schematic configuration of the reverse rotation suppression mechanism.

As shown in FIGS. 11 and 12, the reverse rotation suppression mechanism 150 includes a rotating body 151 which is integrally rotatable with the winding roller 82, a non-rotatable body 152 which is disposed fixed to the right side surface of the housing 80, and a plurality of (three in the present embodiment) external toothed gears 153 which are accommodated between the rotating body 151 and the non-rotatable body 152.

The rotating body 151 is formed in a bottomed-cylinder shape, and the outside surface thereof forms a cover portion 154 which is capable of covering the non-rotatable body 152 and the external toothed gears 153 from the outside (the right side) in the axial direction. In addition, as shown in FIG. 12, internal teeth 155 and a bearing portion 156 are formed on the inner surface of the rotating body 151. The internal teeth 155 are formed in a ring shape facing the axial line and the bearing portion 156 is formed so as to be capable of engaging with the axial end portion 82*a* of the winding roller 82. Here, in order to prevent the axial end portion 82*a* of the winding roller 82 and the bearing portion 156 of the rotating body 151 from sliding against one another when rotating, the cross-sectional shape thereof in the axial direction is formed in a non-circular shape. Accordingly, the rotating body 151 is configured so as to be integrally rotatable with the winding roller 82.

As shown in FIGS. 11 and 12, the non-rotatable body 152 is substantially cylindrical and includes a bearing hole 157 which is formed through the winding roller 82 in the axial direction, an arc portion 158 which forms the cylindrically shaped part, and a withdrawn portion 159 which is formed in a concave shape so as to be further withdrawn than the arc portion toward the axial line of the non-rotatable body 152. The bearing hole 157 is configured to be capable of rotatably supporting the axial end portion 82*a* in a state in which the axial end portion 82*a* of the winding roller 82 is inserted therethrough.

When the rotating body 151 rotates integrally with the winding roller 82, the arc portion 158 of the non-rotatable body 152, which is disposed fixed to the wiper cassette 31, can slide on the internal teeth 155 of the rotating body 151. In addition, the withdrawn portion 159 of the non-rotatable body 152 is configured so as to be capable of accommodating the external toothed gears 153 between the rotating body 151 and the internal teeth 155. In addition, a rotation permission portion 159*a* which permits the rotation of the external toothed gears 153 by allowing the external toothed gears 153 to slide, and a rotation restriction portion 159*b* which restricts the rotation of the external toothed gears 153 by engaging the external toothed gears 153 are formed on the withdrawn portion 159. In order to allow the external toothed gears 153 to slide, the rotation permission portion 159*a* is formed as a smooth curved surface. Meanwhile, the rotation restriction portion 159*b* is formed in a substantially triangular tab shape when cross-sectionally viewed in the axial direction (the left-right direction) of the winding roller 82 and is configured to be capable of restricting the rotation of the external toothed gears 153 by meshing with the external toothed gears 153. In addition, in the withdrawn portion 159, the rotation permission portion 159*a* is formed on the winding rotation direction side (the counter-clockwise direction side in FIG. 12) of the winding roller 82, and the rotation restriction portion 159*b* is formed on the feeding rotation direction side (the clockwise direction side in FIG. 12) of the winding roller 82.

The external toothed gears 153 is accommodated within the withdrawn portion 159 of the non-rotatable body 152 in a state of meshing with the internal teeth 155 of the rotating body 151. Furthermore, the external toothed gears 153 is configured so as to be rotatable within the withdrawn portion 159 by the load applied from the internal teeth 155 of the rotating body 151 which rotates. In addition, by moving inside the withdrawn portion 159 in the circumferential direction of the rotating body 151 together with the rotation of the external toothed gears 153 itself, the external toothed gears 153 can slide against the rotation permission portion 159*a* and engage with the rotation restriction portion 159*b*.

In this manner, the reverse rotation suppression mechanism 150 is configured so as to be capable of permitting rotation in the direction in which the winding roller 82 winds the wiping member 30, and capable of restricting rotation in the feeding direction. In addition, inside of the reverse rotation suppression mechanism 150, it is preferable that lubricant for reducing the frictional resistance be applied to the portion at which the internal teeth 155 and the external toothed gears 153 mesh with one another, and to the portion at which the rotation permission portion 159*a* and the external toothed gears 153 slide against one another.

Next, description will be given of the actions of the printer 11, which is configured as described above.

First, description will be given of the actions when the wiper unit 34 maintains the liquid ejecting head 22.

As shown in FIGS. 1 and 2, when performing maintenance of the liquid ejecting head 22, the liquid ejecting head 22 is caused to move to the home position HP. Furthermore, the drive mechanism 33 is driven to cause the wiper holder 32 to move in the forward direction, which is a direction which intersects the main scanning direction X. As a result, the portion of the wiping member 30 which is wound around the pressing roller 87 wipes the ink from the nozzle forming surface by sliding against the liquid ejecting head 22.

Furthermore, when the wiping of the nozzle forming surface of the liquid ejecting head 22 completes by the forward movement of the wiper holder 32, the drive motor 48 of the drive mechanism 33 is driven in reverse. As a result, the wiper holder 32 starts to move in the reverse direction (backward) due to the drive mechanism 33. Furthermore, in this case, too, the portion of the wiping member 30 which is wound around the pressing roller 87 wipes the ink from the nozzle forming surface by sliding against the liquid ejecting head 22.

Furthermore, when the reciprocal wiping operation in the front-back direction completes, the drive force of the drive mechanism 33 is transmitted to the winding gear 85 and the wiping member 30 to which ink is adhered is wound around the winding roller 82. Furthermore, when performing this winding, the restriction of the rotation of the feed roller 81 is released due to the protruding piece 116 pushing against the ratchet 115. In this manner, the maintenance in relation to the wiping operation of the liquid ejecting head 22 by the wiper unit 34 completes.

Next description will be given of the operations when detecting the amount of the wiping member 30 fed out from the feed roller 81 to the winding roller 82.

Figure 13A:
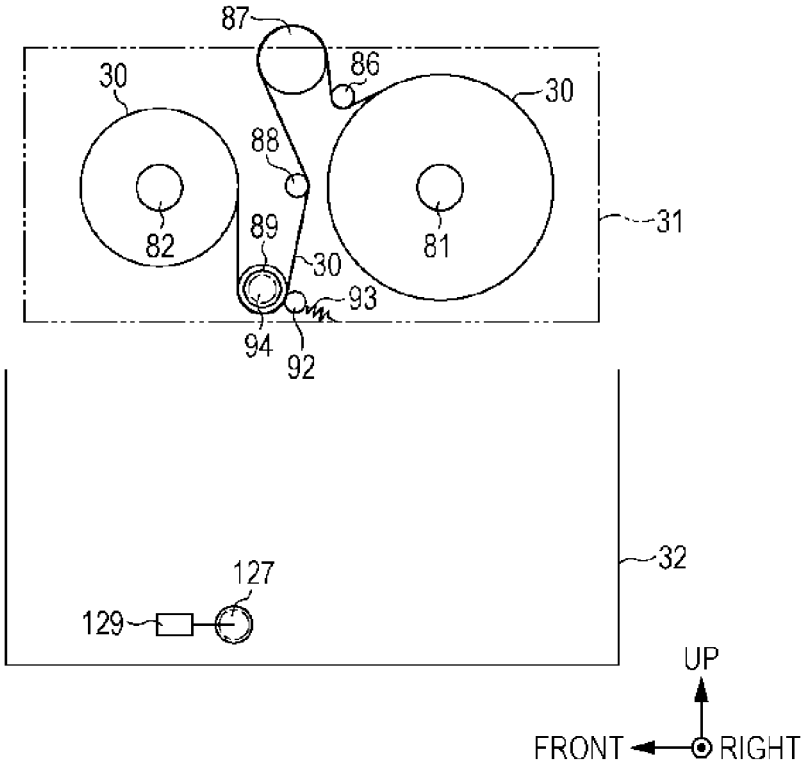
FIG. 13A is a side view schematically showing the wiper cassette in a state of being removed upward from the wiper holder.

As shown in FIG. 13A, in a state in which the wiper cassette 31 to be mounted is positioned vertically above the wiper holder 32, the relay gear 94 which is provided in the wiper cassette 31 is disposed in a position opposing the detection gear 127, which is provided in the wiper holder 32, in the up-down direction.

Figure 13B:
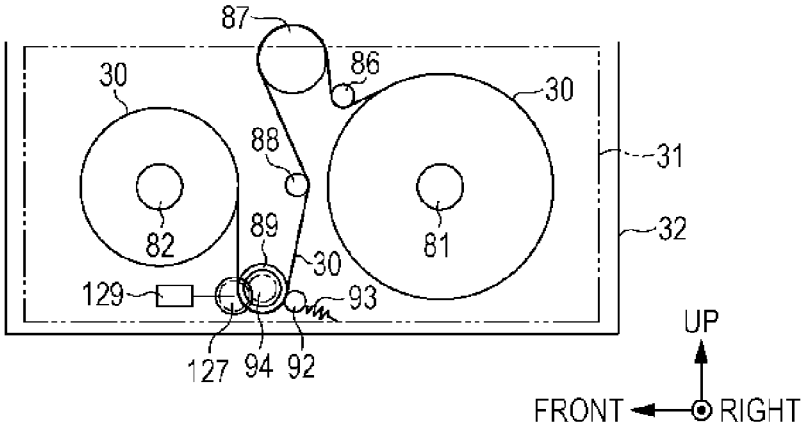
FIG. 13B is a side view schematically showing the wiper cassette in a state of being mounted into the wiper holder from the state shown in FIG. 13A.
Figure 13C:
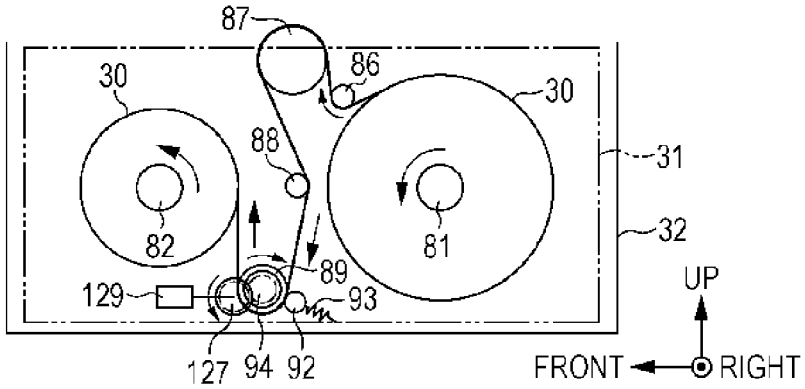
FIG. 13C is a side view schematically showing the wiper cassette in a state in which the wiping member is fed out from the state shown in FIG. 13B.

Furthermore, as shown in FIG. 13B, when the wiper cassette 31 is mounted into the wiper holder 32, the relay gear 94 meshes with the detection gear 127 such that force transmission can occur therebetween from the upper side. Next, as shown in FIG. 13C, when the wiping member 30 is fed out from the feed roller 81 to the winding roller 82, the relay roller 89 around which the wiping member 30 is wound rotates together with the feeding operation of the wiping member 30. As a result, the rotation amount of the relay roller 89 is transmitted to the detection gear 127 via the relay gear 94, and the rotation amount of the shaft 127*a*, which corresponds to the rotation amount of the relay roller 89, is detected by the rotary encoder 129 which is provided in the wiper holder 32.

Here, the rotation amount of the relay roller 89 does not depend on the amount of the wiping member 30, which is wound around the feed roller 81 and the winding roller 82, remaining to be wound, and accurately reflects the amount of the wiping member 30 fed out from the feed roller 81 to the winding roller 82. Therefore, the rotary encoder 129 can accurately detect the amount of the wiping member 30 fed out from the feed roller 81 to the winding roller 82 via the detection of the rotation amount of the relay roller 89.

Furthermore, the relay roller 89 strongly pinches the wiping member 30 between the relay roller 89 and the pinching roller 92 which is biased by the spring member 93. Therefore, the sliding of the wiping member 30 in the feeding direction in relation to the circumference of the relay roller 89 is suppressed. As a result, the rotation amount of the relay roller 89 accurately reflects the amount of the wiping member 30 fed out from the feed roller 81 to the winding roller 82. Accordingly, the rotary encoder 129 is capable of detecting the feeding amount of the wiping member 30 in a more accurate manner.

Next, description will be given of the operations when attaching and detaching the wiper cassette 31 in relation to the wiper holder 32.

Figure 14A:
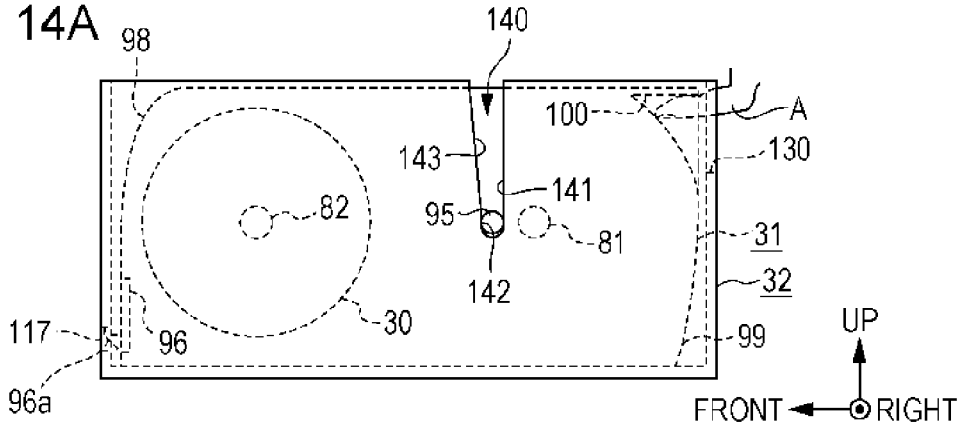
FIG. 14A is a side view schematically showing a state before the wiper cassette is removed from the wiper holder.

As shown in FIG. 14A, when the wiper cassette 31 is removed from the wiper holder 32, the user inserts a fingertip A inside of the wiper holder 32 via the concave portion 130 of the wiper holder 32. Furthermore, in a state of gripping the finger grip portion 100 of the wiper cassette 31 with the fingertip A, the user lifts the finger grip portion 100 of the wiper cassette 31 upward in the vertical direction. Furthermore, the finger grip portion 100 is formed on the up direction side, which is closer to the removal direction side than the winding gear 85 which is supported by the winding roller 82. Therefore, the gripping operation using the fingertip A is simplified for the user without the winding gear 85 being a hindrance.

Figure 14B:
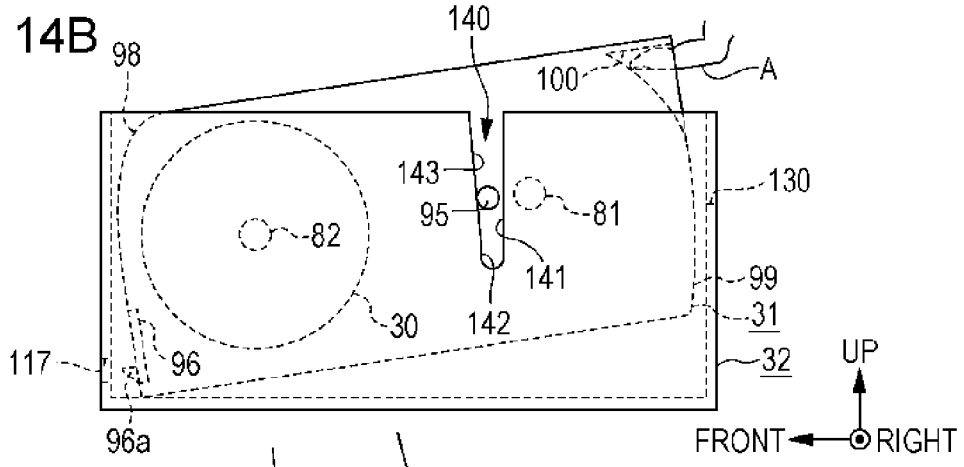
FIG. 14B is a side view schematically showing the wiper cassette in a tilted state.

As a result, as shown in FIG. 14B, the engaging protrusions 95 of the wiper cassette 31 are displaced facing upward inside of the engaging concave portions 140 of the wiper holder 32. In this case, within the engaging concave portions 140, the engaging protrusions 95 slide in the upward direction against the inclined surface 143 which is positioned close to the opposite side from the finger grip portion 100 on which the force from the fingertip A acts. Furthermore, a portion near the front end of the wiper cassette 31, which is positioned on the opposite side from the finger grip portion 100 in the front-back direction which intersects the protrusion direction of the engaging protrusions 95, sinks downward and slides against the inner bottom surface of the wiper holder 32 while the wiper cassette 31 tilts centered on the engaging protrusions 95. In other words, the engaging protrusions 95, which are the center of the tilting of the wiper cassette 31, slide along the inclined surfaces 143 which configure a portion of the inner surfaces of the engaging concave portions 140 and are guided in the upward direction which is the removal direction of the wiper cassette 31. Furthermore, the engaging concave portions 140 function as guide portions which guide the engaging protrusions 95, which serve as guided portions, in the removal direction of the wiper cassette 31.

Furthermore, the curved surfaces 98 and 99 are formed in the corner portions of the profile of the wiper cassette 31 when viewed from the left-right direction, which is the protrusion direction of the engaging protrusions 95. Therefore, the wiper cassette 31 can tilt smoothly centered on the engaging protrusions 95 without being interfered with by the inner surface of the wiper holder 32. In addition, when the wiper cassette 31 is exchanged, normally, the wiping member 30 to which the ink is adhered has an increased mass and is wound around the winding roller 82. As a result, the center of gravity of the wiper cassette 31 moves to the winding roller 82 side in the front-back direction in comparison to when the wiping member 30 is not used and the wiper cassette 31 may tilt more easily.

In addition, when the wiper cassette 31 tilts with the engaging protrusions 95 as the center of rotation, the locking tab 96*a*, which is formed in a position on the opposite side from the finger grip portion 100 so as to interpose the engaging protrusions 95 when viewed from the left-right direction which is the protrusion direction of the engaging protrusions 95, is released from the locking hole 117 of the wiper holder 32. Therefore, the wiper cassette 31 is no longer locked in the up-down direction in relation to the wiper holder 32.

Figure 14C:
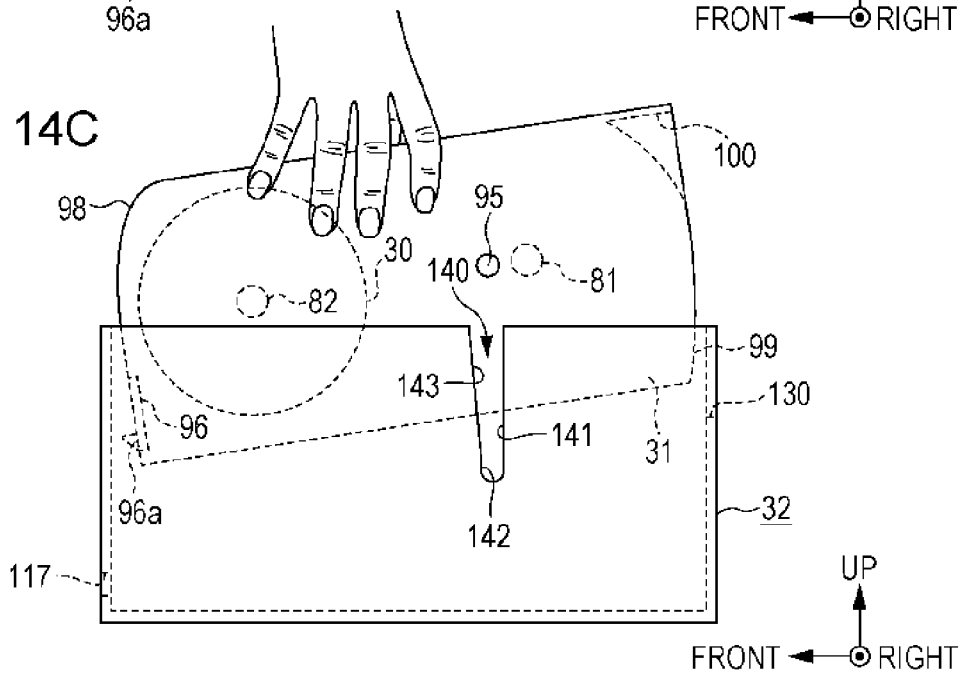
FIG. 14C is a side view schematically showing the wiper cassette in a state of being removed.

Subsequently, as shown in FIG. 14C, together with the tilting of the wiper cassette 31, the user grips a portion of the wiper cassette 31 which is close to the top thereof and is exposed from the wiper holder 32, and removes the wiper cassette 31 from the wiper holder 32 to the opposite side in the vertical direction.

Figure 15A:
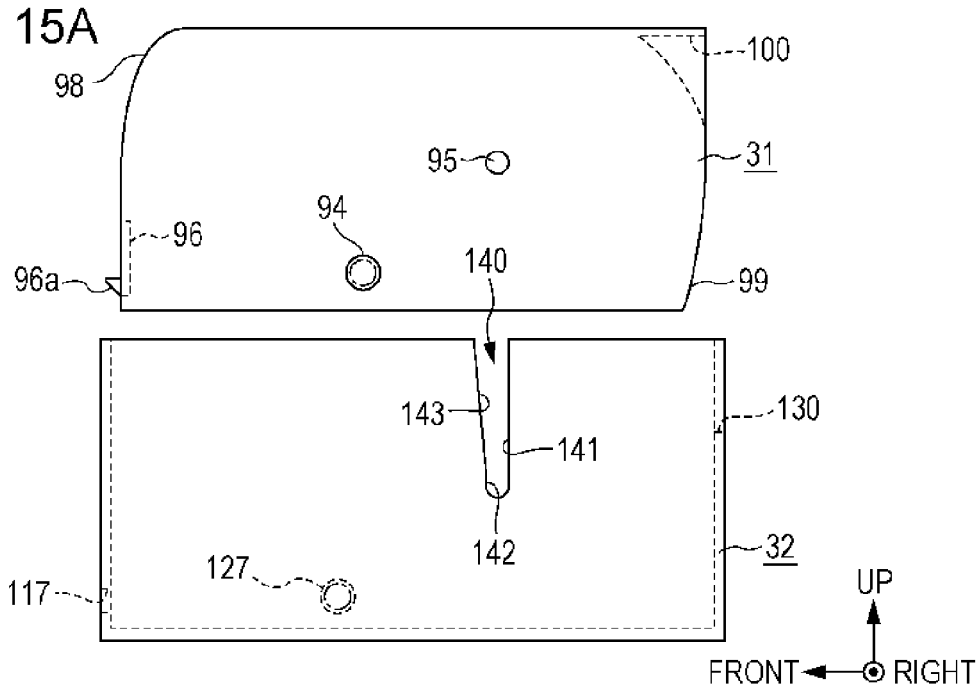
FIG. 15A is a side view schematically showing a state before the wiper cassette is mounted into the wiper holder.

In addition, as shown in FIG. 15A, when mounting the wiper cassette 31 into the wiper holder 32, the positions of the engaging protrusions 95 of the wiper cassette 31 are matched with the positions of the engaging concave portions 140 of the wiper holder 32. Furthermore, when matching the positions, for example, when the detection gear 127 which can mesh with the relay gear 94 is provided in a position close to the upper end of the wiper holder 32, there is a concern that the lower end portion of the wiper cassette 31 may contact the detection gear 127 and that a shock may act on the rotation amount detection unit 120 which includes the detection gear 127. Therefore, it is necessary for the user to pay great attention mounting the wiper cassette 31 into the wiper holder 32. Conversely, in the present embodiment, since the detection gear 127 is provided in a position close to the bottom end of the wiper holder 32, it is not necessary for the user to pay as much attention.

Figure 15B:
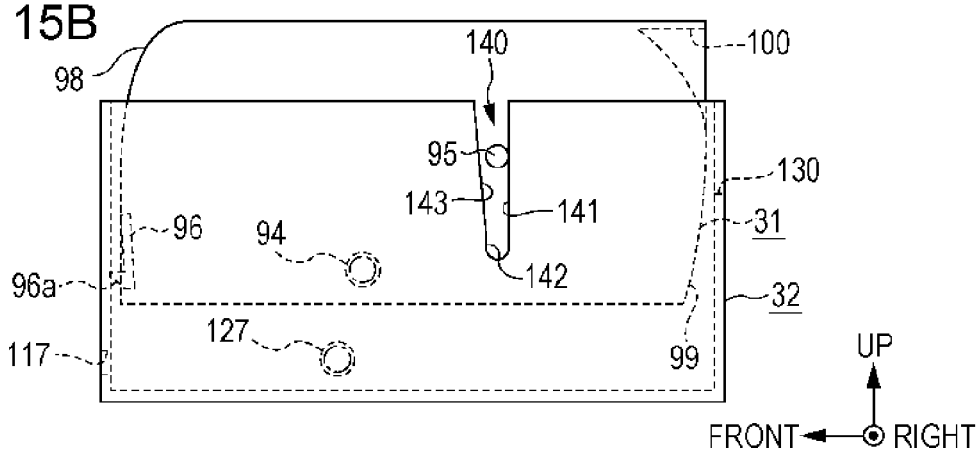
FIG. 15B is a side view schematically showing a state during the wiper cassette being mounted into the wiper holder.

Next, as shown in FIG. 15B, the engaging protrusions 95 of the wiper cassette 31 are inserted from above into the engaging concave portions 140 of the wiper holder 32 by displacing the wiper cassette 31 vertically downward while maintaining a horizontal orientation. In this case, the wiper cassette 31 is mounted into the wiper holder 32 while positioning the engaging protrusions 95 in the front-back direction, which intersects the protrusion direction thereof, using the engaging concave portions 140. Furthermore, the length dimensions of the engaging concave portions 140 in the front-back direction of the opening of the upper side are set slightly larger than the diameters of the engaging protrusions 95. Therefore, the engaging protrusions 95 can be easily inserted into the engaging concave portions 140 from above. In addition, the locking tab 96*a* slides against the inside surface of the wiper holder 32 while causing the elastic piece 96 to elastically deform with the upper end portion thereof as the fixed end.

Figure 15C:
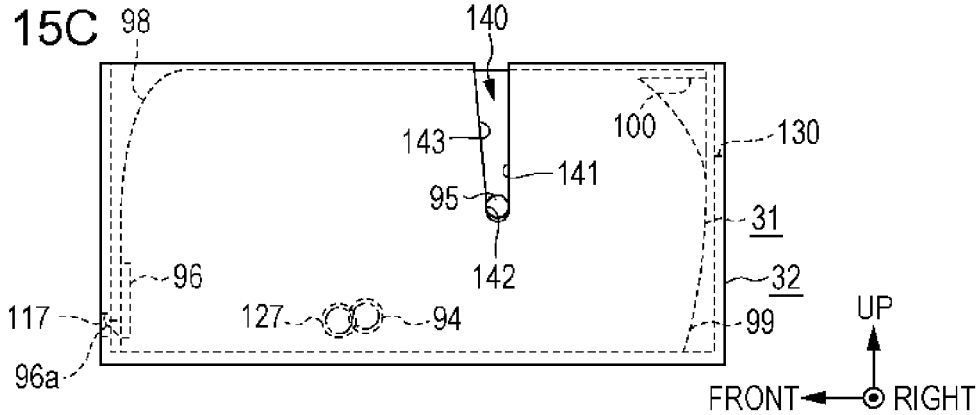
FIG. 15C is a side view schematically showing a state in which the wiper cassette is mounted into the wiper holder.

Subsequently, as shown in FIG. 15C, when the engaging protrusions 95 are inserted into the engaging concave portions 140 so as to reach the bottom end portions, which are the inside thereof, the engaging protrusions 95 are locked from both the front and back sides by the respective vertical surfaces 141 and 142 of the engaging concave portions 140. Furthermore, the wiper cassette 31 is positioned in the front-back direction in relation to the wiper holder 32. In addition, the locking tab 96*a* is locked in relation to the locking hole 117 of the wiper holder 32 according to the elastic return force of the elastic piece 96. Accordingly, the mounting operation of the wiper cassette 31 into the wiper holder 32 is completed.

Next, description will be given of the effects of the reverse rotation suppression mechanism 150 which is provided on the axial end portion 82*a* of the winding roller 82.

Figure 16:
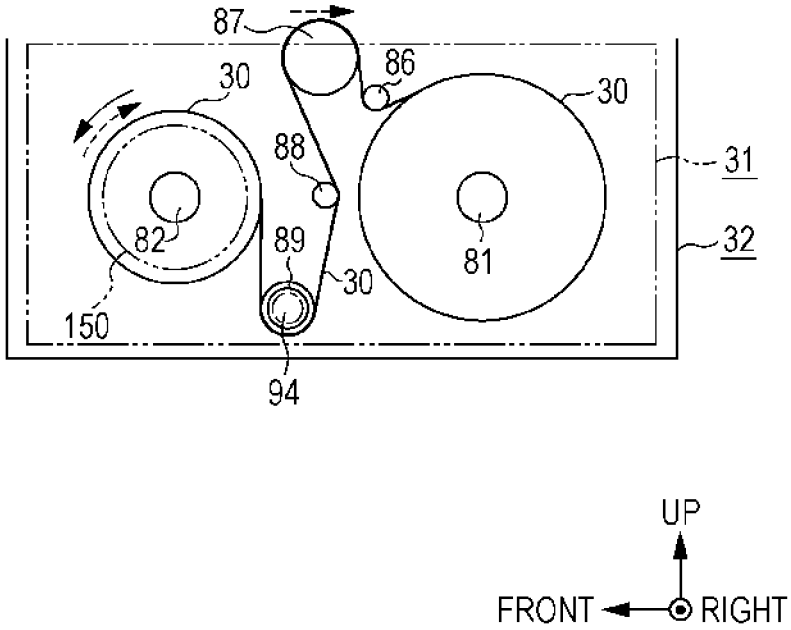
FIG. 16 is a schematic view showing the actions of the reverse rotation suppression mechanism.

As shown in FIG. 16, when the winding of the wiping member 30 is performed at a time such as after the wiping operation by the wiper unit 34 in relation to the liquid ejecting head 22 is completed, the winding roller 82 rotates in the direction of the solid line arrow in FIG. 16. As a result, the reverse rotation suppression mechanism 150 which is mounted on the axial end portion 82*a* of the winding roller 82 operates as follows.

Figure 17A:
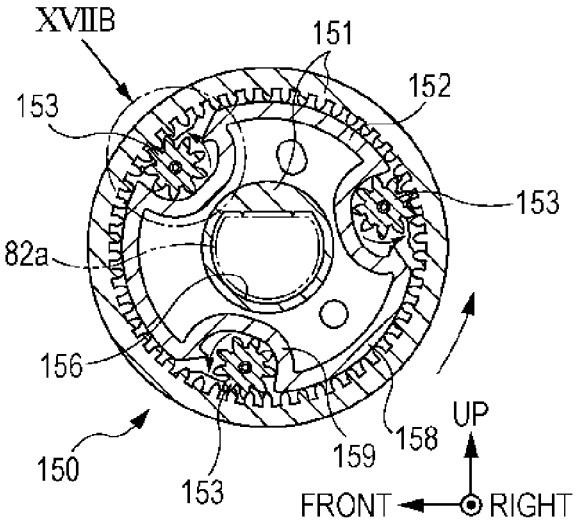
FIG. 17A is a cross-section view of the reverse rotation suppression mechanism during rotation permission.
Figure 17B:
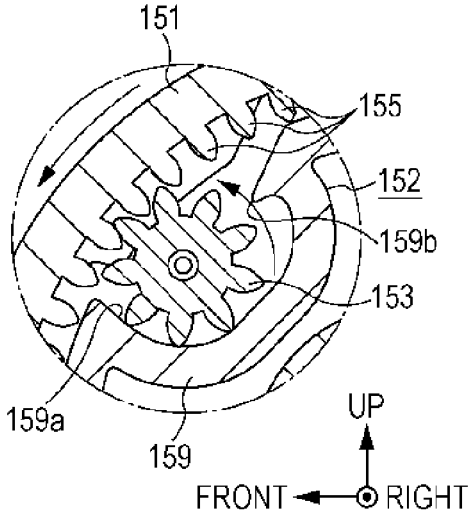
FIG. 17B is an enlarged view of the main components of FIG. 17A.

As shown in FIGS. 17A and 17B, when the winding roller 82 rotates in the direction (the counter-clockwise direction in FIGS. 17A and 17B) in which the wiping member 30 is wound, the rotating body 151 which is in an engaged relationship with the axial end portion 82*a* of the winding roller 82 integrally rotates in the same direction. As a result, the external toothed gears 153 which are in a meshed relationship with the internal teeth 155 of the rotating body 151 rotate in the counter-clockwise direction in FIGS. 17A and 17B, and slide against the rotation permission portion 159*a* of the non-rotatable body 152. In this manner, when the winding roller 82 rotates in the winding direction of the wiping member 30, the reverse rotation suppression mechanism 150 does not restrict the rotation of the winding roller 82.

Meanwhile, as shown in FIG. 16, when the wiper holder 32 moves in the forward direction which is the direction intersecting the main scanning direction X, the wiping member 30 which is wound around the pressing roller 87 slides on the nozzle forming surface of the liquid ejecting head 22. As a result, tension acts on the wiping member 30 in the broken line arrow direction of FIG. 16. Furthermore, the winding roller 82 has a tendency to rotate in the feeding direction of the wiping member 30 due to a moment of force corresponding to the tension. As a result, the reverse rotation suppression mechanism 150 which is mounted on the axial end portion 82*a* of the winding roller 82 operates as follows.

Figure 18A:
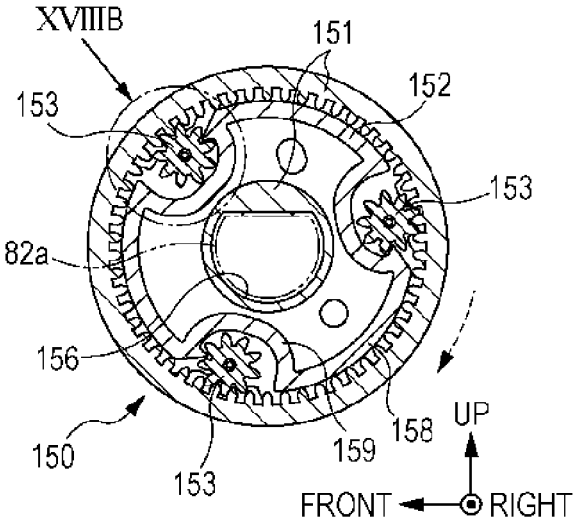
FIG. 18A is a cross-section view of the reverse rotation suppression mechanism during rotation restriction.
Figure 18B:
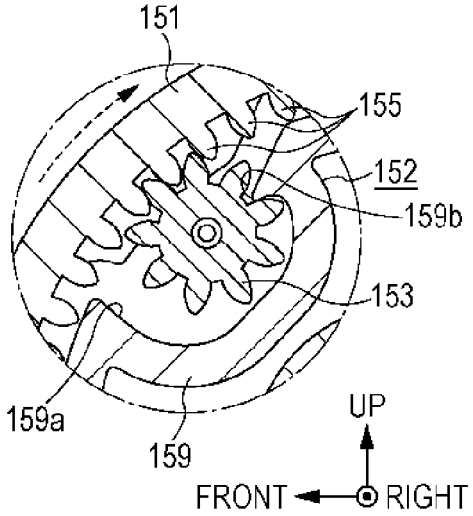
FIG. 18B is an enlarged view of the main components of FIG. 18A.

As shown in FIGS. 18A and 18B, when the winding roller 82 rotates in the direction (the clockwise direction in FIGS. 18A and 18B) in which the wiping member 30 is fed out, the rotating body 151 which is in an engaged relationship with the axial end portion 82*a* of the winding roller 82 integrally rotates in the same direction by a minute amount. As a result, the external toothed gears 153 which are in a meshed relationship with the internal teeth 155 of the rotating body 151 rotate in the clockwise direction in FIGS. 17A and 17B, and move toward the rotation restriction portion 159*b* from the rotation permission portion 159*a* within the withdrawn portion 159 of the non-rotatable body 152. Finally, the external toothed gears 153 abut the rotation restriction portion 159*b*, engage therewith, and are restricted from rotating any further. As a result, the rotating body 151 which includes the internal teeth 155 which is in a meshed relationship with the external toothed gears 153 is also restricted from rotating any further. The winding roller 82 which is in an engaged relationship with the rotating body 151 is also restricted from rotating in the same manner. In this manner, when the winding roller 82 rotates in the feeding direction of the wiping member 30, the reverse rotation suppression mechanism 150 restricts the rotation of the winding roller 82. Therefore, by moving the wiper holder 32 forward, the unintentional feeding of the wiping member 30 is suppressed when the nozzle forming surface of the liquid ejecting head 22 is being wiped.

According to the embodiments described above, it is possible to obtain the following effects.

(1) When the wiper cassette 31 is removed from the wiper holder 32, the finger grip portion 100 upon which the user places their hand is positioned closer to the upward direction which is the removal direction than the winding gear 85. Therefore, when the user places their hand on the finger grip portion 100 in order to remove the wiper cassette 31, the concern that the winding gear 85 becomes a hindrance may be reduced and the wiper cassette 31 may be easily removed. Accordingly, favorable operability during the exchange of the wiper cassette 31 by detachment and attachment may be achieved.

(2) For example, when the relay gear 94 is positioned further up than the finger grip portion 100, the relay gear which meshes with the relay gear 94 is positioned at the top of the wiper holder 32. In such a case, when the wiper cassette 31 is mounted into the wiper holder 32 and the lower end portion of the wiper cassette 31 makes strong contact with the detection gear 127, there is a concern that an impact will act on the rotation amount detection unit 120. Therefore, it is necessary for the user to pay great attention mounting the wiper cassette 31 into the wiper holder 32. Conversely, according to the configuration described above, the detection gear 127 which meshes with the relay gear 94 is positioned closer to the opposite side (the lower side) of the removal direction from the wiper holder 32 than the finger grip portion 100. Therefore, in comparison with a case in which the detection gear 127 is positioned closer to the removal direction side (the upper side) than the finger grip portion 100, it is less necessary to be careful at least when starting to mount the wiper cassette 31 into the wiper holder 32. Accordingly, favorable operability during the mounting of the wiper cassette 31 may be achieved.

(3) Due to repeatedly wiping the ink adhered to the liquid ejecting head 22, the wiping member 30 to which the ink is adhered has an increased mass and is wound around the winding roller 82. As a result, the center of gravity of the wiper cassette 31 moves closer to the winding roller 82 side in the front-back direction (the axial intersection direction) in comparison to when the wiping member 30 is not used. According to the configuration described above, when removing the wiper cassette 31, a load for removing the wiper cassette 31 is applied to the finger grip portion 100 which is positioned such that the finger grip portion 100 and the winding roller 82 interpose the feed roller 81. Accordingly, when the user places their hand on the finger grip portion 100 and removes the wiper cassette 31, the wiper cassette 31 may tilt more easily with the center of gravity, which is near the winding roller 82, as the center of rotation. Therefore, in comparison to a case in which the wiper cassette 31 is pulled up vertically, the wiper cassette 31 may be removed using less power.

(4) Since the finger grip portion 100 is provided to extend in a direction (the forward direction) intersecting the removal direction (the upward direction), for example, in comparison to a case in which the finger grip portion 100 is provided to extend in the removal direction, favorable user operability may be achieved when removing the wiper cassette 31 from the wiper holder 32.

(5) The wiper cassette 31 in a state of being mounted in the wiper holder 32 is locked to the wiper holder 32 via the locking tab 96*a*. Therefore, it is possible to suppress the unintentional removal of the wiper cassette 31 from the wiper holder 32 due to a force which acts on the wiper cassette 31 when wiping the ink adhered to the liquid ejecting head 22 or the like. Meanwhile, when removing the wiper cassette 31 from the wiper holder 32, the locking tab 96*a* is positioned such that the locking tab 96*a* and the finger grip portion 100 interpose the winding roller 82. Therefore, by tilting the wiper cassette 31 via the finger grip portion 100, it is possible to easily release the fixing to the wiper holder 32 by the locking tab 96*a*.

(6) Since the wiping member 30 which has already wiped the ink is fed out from the winding roller 82, it is possible to suppress the occurrence of bending and the like of the wiping member 30. In other words, it is possible to suppress poor wiping caused by bending and the like of the wiping member 30.

(7) The reverse rotation suppression mechanism 150 is provided on the opposite side from the axial end portion 82*a* of the winding roller 82 at which the winding gear 85 is already supported. Therefore, it is possible to suppress a concentration of components of the wiper cassette 31 at one of the axial end portions of the winding roller 82. Accordingly, it is possible to improve the ease of assembly and the maintainability of the wiper cassette 31.

(8) It is possible to adopt a configuration in which the non-rotatable body 152 and the external toothed gear 153, which are the internal mechanism of the reverse rotation suppression mechanism 150, are covered using a cover portion 154 and are not exposed to the outside of the wiper cassette 31. Therefore, it is possible to suppress contamination by foreign materials from the outside, and it is possible to raise the reliability of the reverse rotation suppression mechanism 150. In addition, by providing the reverse rotation suppression mechanism 150 in the wiper cassette 31, even in a case in which the wiper cassette 31 is in a state of not being mounted into the wiper holder 32, it is possible to suppress the rotation of the winding roller 82 in the direction in which the wiping member 30 is fed out.

(9) By moving the wiper holder 32 relative to the liquid ejecting head 22, the wiper unit 34 can wipe the ink which is adhered to the liquid ejecting head 22. In addition, when the wiping member 30 is consumed, it is possible to continue using the wiper unit 34 by exchanging the wiper cassette 31 by detachment and attachment thereof.

(10) When the wiping member 30 is wound onto the winding roller 82 (when forward rotation is permitted), none of the rotating body 151, the non-rotatable body 152 or the external toothed gears 153 which configure the reverse rotation suppression mechanism 150 undergo elastic deformation. Conversely, in a general reverse rotation suppression mechanism which is configured by gears and ratchets the ratchets undergo elastic deformation when forward rotation is permitted, and a sound may be generated as the deformed ratchets return to their original shape and make contact with the gears. In other words, according to the reverse rotation suppression mechanism 150 of the present embodiment, it is possible to reduce the noise generated when forward rotation is permitted.

Furthermore, the embodiments described above may also be modified as follows.

Figure 19:
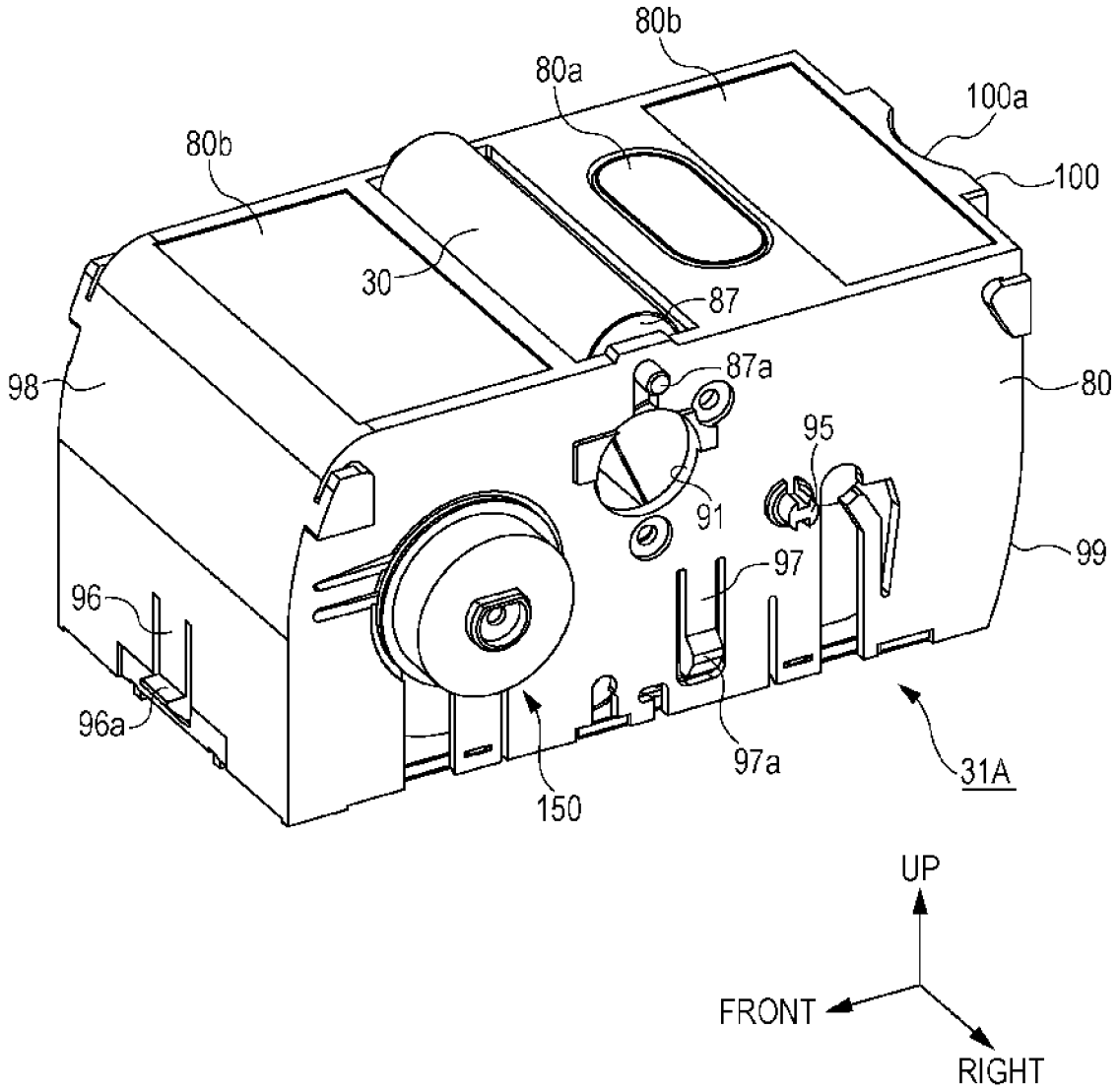
FIG. 19 is a perspective view showing the schematic configuration of the wiper cassette of a modification example.

In the embodiments described above, as shown in FIG. 19, the finger grip portion 100 may be provided to extend toward the outside (the rear side) of the wiper cassette 31, and a finger contact portion 100*a*, which is formed in a convex manner toward the opposite direction from the extending direction, may also be provided. In addition, a label-pasting surface 80*b*, for pasting a warning message (a caution label) in relation to using the wiper cassette 31, may also be provided on the upper surface of the wiper cassette 31.

In the embodiments described above, the components for detecting the feeding amount of the wiping member 30, such as the relay roller 89 may be omitted from the wiper cassette 31. In addition, the rotation amount detection unit 120 may also be omitted from the wiper holder 32.

In the embodiments described above, at least a portion of the components configuring the rotation amount detection unit 120 may be provided on the wiper cassette 31 side.

In the embodiments described above, the rotation amount detection unit 120 may also detect the amount of the wiping member 30 fed out from the feed roller 81 to the winding roller 82 through the detection of the rotation amount of the pressing roller 87 or the tension rollers 86 and 88.

In the embodiments described above, as the power point acting portion, at which the load acts on the wiper cassette 31 toward the removal direction from the wiper holder 32, a protruding portion which is gripped by the fingertip of the user may be provided, and a rough surface portion with which the fingertip of the user frictionally engages may also be provided. The power point acting portion may also be formed on any surface of the housing 80 of the wiper cassette 31, as long as the power point acting portion is above the winding gear 85.

In the embodiments described above, it is not necessary to position the finger grip portion 100 above the relay gear 94 in a state in which the wiper cassette 31 is mounted into the wiper holder 32. In addition, it is not necessary for the feed roller 81 to be positioned between the winding roller 82 and the finger grip portion 100 in the front-back direction. In addition, it is not necessary for the winding roller 82 to be positioned between the finger grip portion 100 and the locking tab 96*a* in the direction which intersects the axial direction of the winding roller 82.

In the embodiments described above, the locking tab 96*a* which locks the wiper cassette 31 in relation to the wiper holder 32 may also be provided on the side at which the finger grip portion 100 is formed. In addition, the locking tab 96*a* may also be omitted.

In the embodiments described above, it is not necessary to provide the reverse rotation suppression mechanism 150 in the axial end portion 82*a* of the winding roller 82. In this case, it is preferable to increase the moment of inertia of the winding roller 82 to prevent the winding roller 82 from easily rotating. Furthermore, the same applies to the feed roller 81.

In the embodiments described above, the reverse rotation suppression mechanism 150 may also be provided on the axial end portion of the feed roller 81. In this case, the components relating to the reverse rotation prevention of the feed roller 81 such as the ratchet 115 may also be omitted.

In the embodiments described above, the number of external toothed gears included in the reverse rotation suppression mechanism 150 may be less than 3, and may also be more than 3.

In the embodiments described above, the wiper unit 34 may also be configured to not wipe the ink from the nozzle forming surface of the liquid ejecting head 22 in both forward and backward directions. In other words, the ink may be wiped only when moving forward or only when moving backward.

In the embodiments described above, the wiper holder 32 may be provided with an engaging protrusion, and the wiper cassette 31 may be provided with an engaging concave portion which engages with the engaging protrusion.

In the embodiments described above, the curved surfaces 98 and 99 of the wiper cassette 31 may be formed in a substantially curved arc shape which is concave facing the outside of the wiper cassette 31. In addition, an interference avoiding shape of the wiper cassette 31 is not limited to a curved shape which is intended not to be interfered with by the wiper holder 32 during tilting of the wiper cassette 31, and may adopt an arbitrary shape as long as the shape is withdrawn further inside than the other portions on the outside surface of the wiper cassette 31.

In the embodiments described above, when the axial lines of the feed roller 81 and the winding roller 82 are disposed shifted in relation to one another in the up-down direction, the axial intersection direction is not the front-back direction, and may be set to a direction in which the axial lines of the rollers 81 and 82 are distanced from one another.

In the embodiments described above, the torsion bar 90 may also be another biasing member such as a plate spring or a coil spring.

In the embodiments described above, the liquid ejecting apparatus may also be a liquid ejecting apparatus which ejects or discharges a liquid other than ink. Furthermore, the state of the liquid discharged as minute droplets from the liquid ejecting apparatus includes liquids of a droplet shape, a tear shape and liquid which form a line shaped tail. In addition, the liquid referred to herein may be a material which can be ejected from a liquid ejecting apparatus. For example, the liquid may be a material which is in a liquid phase state, and includes liquid bodies of high or low viscosity, and fluid bodies such as sol, gel water, other inorganic solvents, organic solvents, solutions, liquid resin, and liquid metal (molten metal). In addition, the liquid not only includes liquids as a state of a material, but also includes solutions, disperses and mixtures in which particles of functional material formed from solids such as pigments and metal particulate are dissolved, dispersed or mixed into a solvent. Representative examples of the liquid include the ink described above or a liquid crystal. Here, the term "ink" includes general aqueous inks and solvent inks, in addition to various liquid compositions such as jell ink and hot melt ink. A specific example of the liquid ejecting apparatus is a liquid ejecting apparatus which ejects a liquid which contains a material such as an electron material or a color material in the form of a dispersion or a solution. The electron material may be used in the manufacture and the like of liquid crystal displays, EL (electro-luminescence) displays, surface emission displays and color filters. In addition, the liquid ejecting apparatus may also be a liquid ejecting apparatus which ejects biological organic matter used in the manufacture of bio-chips, a liquid ejecting apparatus which is used as a precision pipette to eject a liquid to be a sample, a textile printing apparatus, a micro dispenser or the like. Furthermore, the liquid ejecting apparatus may also be a liquid ejecting apparatus which ejects lubricant at pinpoint precision into precision machines such as clocks and cameras, or a liquid ejecting apparatus which ejects a transparent resin liquid such as ultraviolet curing resin onto a substrate in order to form minute semispherical lenses (optical lenses) used in optical communication elements and the like. In addition, the liquid ejecting apparatus may also be a liquid ejecting apparatus which ejects an acidic or alkaline etching liquid for etching a substrate or the like.

The entire disclosure of Japanese Patent Application No. 2012-248464, filed Nov. 12, 2012 is expressly incorporated by reference herein.

What is claimed is:

1. A wiper cassette comprising:

a long wiping member which wipes a liquid adhered to a liquid ejecting head which ejects the liquid;

a feed roller around which an end of the wiping member is wound in a longitudinal direction; and a winding roller around which other end of the wiping member is wound in the longitudinal direction, a reverse rotation suppression mechanism which suppresses rotation of the winding roller in a direction in which the wiping member is fed out, the reverse rotation suppression mechanism being mounted on an end of the winding roller, wherein the wiper cassette is mounted so as to be freely detachable and attachable into a wiper holder, wherein the wiper cassette further comprises a winding gear supported by the winding roller; and a power point acting portion on which a load acts in a removal direction when the wiper cassette is removed from the wiper holder.

2. The wiper cassette according to claim 1, further comprising:

a relay roller which is rotated by feeding the wiping member from the feed roller to the winding roller; and a relay gear which is supported by the relay roller so as to be capable of meshing with a detection gear, where the detection gear is included in a rotation amount detection unit which is provided in the wiper holder in order to detect a feeding amount of the wiping member, wherein the power point acting portion is positioned closer to the removal direction side than the relay gear in a mounted state.

3. The wiper cassette according to claim 1, wherein the feed roller is positioned between the winding roller and the power point acting portion in an axial intersection direction, which is the direction between the feed roller and the winding roller.

4. The wiper cassette according to claim 1, wherein the power point acting portion is provided to extend in a direction intersecting the removal direction.

5. The wiper cassette according to claim 1, further comprising:

a locking portion which is locked to the wiper holder in a mounted state, wherein the winding roller is positioned between the power point acting portion and the locking portion in a direction intersecting an axial direction of the winding roller.

6. The wiper cassette according to claim 1, wherein, in an axial direction of the winding roller, the reverse rotation suppression mechanism is provided on an axial end portion of an opposite side from the axial end portion at which the winding gear is supported.

7. The wiper cassette according to claim 1, wherein the reverse rotation suppression mechanism includes a rotating body which includes internal teeth which can be rotated integrally with the winding rollers; an external toothed gear which meshes with the internal teeth and can be rotated by rotation of the rotating body; and a non-rotatable body which is not rotatable in relation to the winding roller, wherein the non-rotatable body includes a rotation permission portion which permits the rotation of the external toothed gear by allowing the external toothed gear to slide, and a rotation restriction portion which restricts the rotation of the external toothed gear by engaging the external toothed gear, and wherein the rotating body includes a cover portion which covers the external toothed gear and the non-rotatable body from outside in the axial direction.

8. A wiper unit comprising:

the wiper cassette according to claim 1; and the wiper holder, wherein, in a mounted state, the wiper holder is movable in relation to the liquid ejecting head in a state in which the wiping member is caused to abut the liquid ejecting head.

9. A liquid ejecting apparatus comprising:

the wiper unit according to claim 8; and the liquid ejecting head.

10. The wiper cassette according to claim 1, wherein the power point acting portion is positioned closer to the removal direction side than the winding gear in the mounted state.

11. The wiper cassette according to claim 1, wherein the reverse rotation suppression mechanism includes a toothed gear which can be rotated by rotation of the winding roller;

a rotation restriction portion which restricts the rotation of the toothed gear by engaging the toothed gear; and a cover portion which covers the toothed gear and the rotation restriction portion.

* * * * *